US012171291B1

(12) United States Patent
Ahn et al.

(10) Patent No.: US 12,171,291 B1
(45) Date of Patent: Dec. 24, 2024

(54) READY-TO-USE EYELASH EXTENSIONS

(71) Applicant: Kiss Nail Products, Inc., Port Washington, NY (US)

(72) Inventors: Kichul Ahn, Plainview, NY (US); Jieun Kim, Woodside, NY (US); Yujin Kim, Bayside, NY (US); Eunbee Kang, Ansan-si (KR); Kyehong Kang, Gyeonggi-do (KR)

(73) Assignee: Kiss Nail Products, Inc., Port Washington, NY (US)

( * ) Notice: Subject to any disclaimer, the term of this patent is extended or adjusted under 35 U.S.C. 154(b) by 0 days.

(21) Appl. No.: 18/589,103

(22) Filed: Feb. 27, 2024

Related U.S. Application Data

(63) Continuation of application No. 17/714,933, filed on Apr. 6, 2022, which is a continuation-in-part of application No. 17/409,705, filed on Aug. 23, 2021, which is a continuation of application No. PCT/US2021/047200, filed on Aug. 23, 2021.

(60) Provisional application No. 63/068,728, filed on Aug. 21, 2020.

(51) Int. Cl.
*A41G 5/02* (2006.01)

(52) U.S. Cl.
CPC ..... *A41G 5/02* (2013.01)

(58) Field of Classification Search
CPC ..... A41G 5/02
See application file for complete search history.

(56) References Cited

U.S. PATENT DOCUMENTS

| | | | | |
|---|---|---|---|---|
| 1,897,747 | A | 2/1933 | Birk | |
| 2,651,310 | A | 9/1953 | Selson | |
| 3,447,542 | A | 6/1969 | McCullough | |
| 3,880,175 | A | 4/1975 | Hosokawa | |
| 3,935,872 | A | 2/1976 | Aylott | |
| 4,018,336 | A | 4/1977 | Aylott | |
| 4,029,111 | A | 7/1977 | Barton | |
| 4,299,242 | A | 11/1981 | Choe | |
| 7,032,602 | B2 | 4/2006 | Chang | |
| D632,019 | S * | 2/2011 | Nguyen | D28/92 |

(Continued)

FOREIGN PATENT DOCUMENTS

| | | | |
|---|---|---|---|
| GB | 1519221 | A | 7/1978 |
| JP | 6130571 | B1 * | 5/2017 |

(Continued)

OTHER PUBLICATIONS

Machine Translation Shim—Available 2014.*

*Primary Examiner* — Rachel R Steitz
*Assistant Examiner* — Brianne E Kalach
(74) *Attorney, Agent, or Firm* — Cherskov Flaynik & Gurda, LLC

(57) ABSTRACT

Provided are an artificial eyelash extension system and its manufacturing method. The artificial eyelash extension system includes a plurality of eyelash extensions, each of which includes a plurality of eyelash filaments and a support surface. Each eyelash filaments has a base and a tip. The support surface is configured to receive adhesive for applying the eyelash extension to a user's natural eyelashes or eyelid. The support surface extends in a first direction across the bases of the plurality of eyelash filaments and includes a plurality of protrusions that extend in a second direction that is substantially perpendicular to the first direction.

26 Claims, 21 Drawing Sheets

(56) References Cited

U.S. PATENT DOCUMENTS

| | | | | |
|---|---|---|---|---|
| 8,225,800 | B2 | 7/2012 | Byrne | |
| 8,424,542 | B1 * | 4/2013 | Han | A41G 5/02 132/218 |
| D771,318 | S * | 11/2016 | Taff | D28/92 |
| 10,433,607 | B2 | 10/2019 | Ahn | |
| 2002/0056465 | A1 | 5/2002 | Shin | |
| 2003/0000540 | A1 | 1/2003 | Makino et al. | |
| 2003/0005941 | A1 | 1/2003 | Iosilevich | |
| 2009/0235950 | A1 | 9/2009 | Dinh | |
| 2010/0043816 | A1 | 2/2010 | Dix | |
| 2012/0180804 | A1 | 7/2012 | Hochi et al. | |
| 2013/0160787 | A1 | 6/2013 | Chae et al. | |
| 2016/0037848 | A1 | 2/2016 | Lee | |
| 2017/0079358 | A1 | 3/2017 | Dinh | |
| 2018/0242671 | A1 | 8/2018 | Merszei | |
| 2018/0352885 | A1 | 12/2018 | Kim | |
| 2019/0159538 | A1 * | 5/2019 | Roh | B23K 26/38 |
| 2019/0183200 | A1 | 6/2019 | Song | |
| 2019/0281913 | A1 | 6/2019 | Roh | |
| 2019/0320750 | A1 | 10/2019 | Ho | |

FOREIGN PATENT DOCUMENTS

| | | | | |
|---|---|---|---|---|
| KR | 101507695 | B1 * | 4/2015 | |
| KR | 20180050446 | | 5/2018 | |
| WO | WO-2014163364 | A1 * | 10/2014 | A41G 5/02 |
| WO | 2015116247 | A1 | 8/2016 | |

* cited by examiner

READY-TO-USE EYELASH EXTENSIONS

This application claims priority as a continuation of U.S. patent application Ser. No. 17/714,933 filed on Apr. 6, 2022, presently pending, which claims priority as a continuation in part of U.S. patent application Ser. No. 17/409,705 filed on Aug. 23, 2021, presently pending, which in turn claims priority as a continuation of PCT/US21/47200 filed on Aug. 23, 2021, presently expired, and priority to U.S. Provisional 63/068,728 filed on Aug. 21, 2020, presently expired, each of which is incorporated herein by reference in its entirety.

BACKGROUND

1. Field

The field of the invention is an artificial eyelash extension system and method for applying same, and more particularly but not exclusively, eyelash filaments having a pre-applied adhesive element.

2. Description of the Related Art

Artificial eyelash extension systems are popular products that are used to improve the look of a user's natural eyelashes line through the addition of eyelashes length and/or volume. Such artificial eyelash extension systems typically comprise a support strip with eyelash filaments extending from there. The eyelash filaments can be made from mink, synthetic materials, horsehair, and in some instances, human hair. Artificial eyelash extension systems are typically applied by spreading adhesive on or around the support strip component of an artificial eyelash extension system and pressing the support strip to a user's eyelash line or proximate thereto. Such artificial eyelash extension systems can be difficult to apply and require that a user have access to both the artificial eyelash extension systems and specialized adhesives.

More recently, do-it-yourself, under-lash eyelash extension systems have been developed. In these systems, a support strip of eyelash extensions is glued to the underside of a user's natural eyelashes in a similar fashion to more traditional above-eyelash extension systems. The do-it-yourself systems often come in small sections (e.g., wisp lashes, cluster lashes, individual lashes), allowing for an inexperienced user to apply the artificial eyelash extension systems without the difficulty of aligning a longer, single strip of eyelash extensions. However, these do-it-yourself systems still require the user to have and apply specialty adhesive either to their lashes or to the artificial eyelash extension system before use.

A need exists in the art for artificial eyelash extension systems that eliminate the difficulties of prior art systems. A need also exists for a means that easily facilitates a user to apply artificial eyelash extension systems without the drawbacks of existing systems.

SUMMARY

An object of the invention is to create artificial eyelash extension systems that overcome many of the drawbacks in the prior art. A feature of the invention is that the artificial eyelash extension systems have pre-applied adhesive elements before being packaged for sale to a user. An advantage of the invention is that the artificial eyelash extension system is ready to use without the need for any additional supplies such as glue. An additional advantage of the invention is that the user can apply the invented artificial eyelash extension system quickly and with one hand.

A further object of the invention is to provide a ready-to-use artificial eyelash extension system having a pre-applied adhesive that is easy for a user to apply. A feature of the invention is that the pre-applied adhesive is droplets of adhesive applied to the eyelash filaments of the artificial eyelash extension system. Alternatively, the invention features double-sided tape as the pre-applied adhesive. An advantage of the invention is that users can apply the invented artificial eyelash extension system without modifying the pre-applied adhesive.

Another object of the invention is to maintain a ready-to-use artificial eyelash extension system in usable condition before use. A feature of the invention is the use of temporary overlayment of a pre-applied adhesive element that is removed before the use of the artificial eyelash extension system. An advantage of the invention is that the pre-applied adhesive elements of the artificial eyelash extension system are maintained in clean condition for use by a user.

Yet another object of the invention is to provide an artificial eyelash extension system that is easily applied by a user onto their natural eyelashes. A feature of the invention is that the artificial eyelash extension system adheres directly to the natural eyelashes of a user at a position not directly adjacent to the eyelid of a user. An advantage of the invention is that by adhering the artificial eyelash extension system to the eyelashes of a user in a position spaced from the eyelid, the user avoids any pain and skin irritation associated with artificial eyelash extension systems that are applied to the skin of the eyelid or adjacent thereto.

The invention provides an artificial eyelash extension system comprising a plurality of eyelash filaments, each having a base and a tip; a support strip attached to the bases of the eyelash filaments, an adhesive element applied to the plurality of the eyelash filaments and/or the support strip before the artificial eyelash extension system is packaged for sale to a user.

Also provided is a method for applying artificial eyelash extension systems comprising providing to a user an artificial eyelash extension system already having an adhesive element disposed on the artificial eyelash extension system before being packaged for sale to the user, moving the adhesive element of the artificial eyelash extension system into contact with the user's natural eyelashes.

BRIEF DESCRIPTION OF THE DRAWINGS

The invention, together with the above and other objects and advantages, will be best understood from the following detailed description of the preferred embodiment of the invention shown in the accompanying drawings, wherein.

DETAILED DESCRIPTION

In various embodiments, the invention provides a ready-to-apply artificial eyelash extension system. The artificial eyelash extension system comprises eyelash filaments extending from a support strip wherein the eyelash filaments feature adhesive elements for attachment to the natural eyelashes of a user. The artificial eyelash extension system may be referred to as a lash extension system or an eyelash extension system.

The foregoing summary, as well as the following detailed description of certain embodiments of the present invention, will be better understood when read in conjunction with the appended drawings.

As used herein, an element or step recited in the singular and proceeded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The phrases "lash," "artificial eyelash," and "eyelash," as used herein, are interchangeable and refer to an apparatus that is not part of the wearer's body unless specifically indicated otherwise (e.g., phrases such as "natural eyelash" or "user's eyelash" refer to a part of the wearer's body).

Figure 1A:
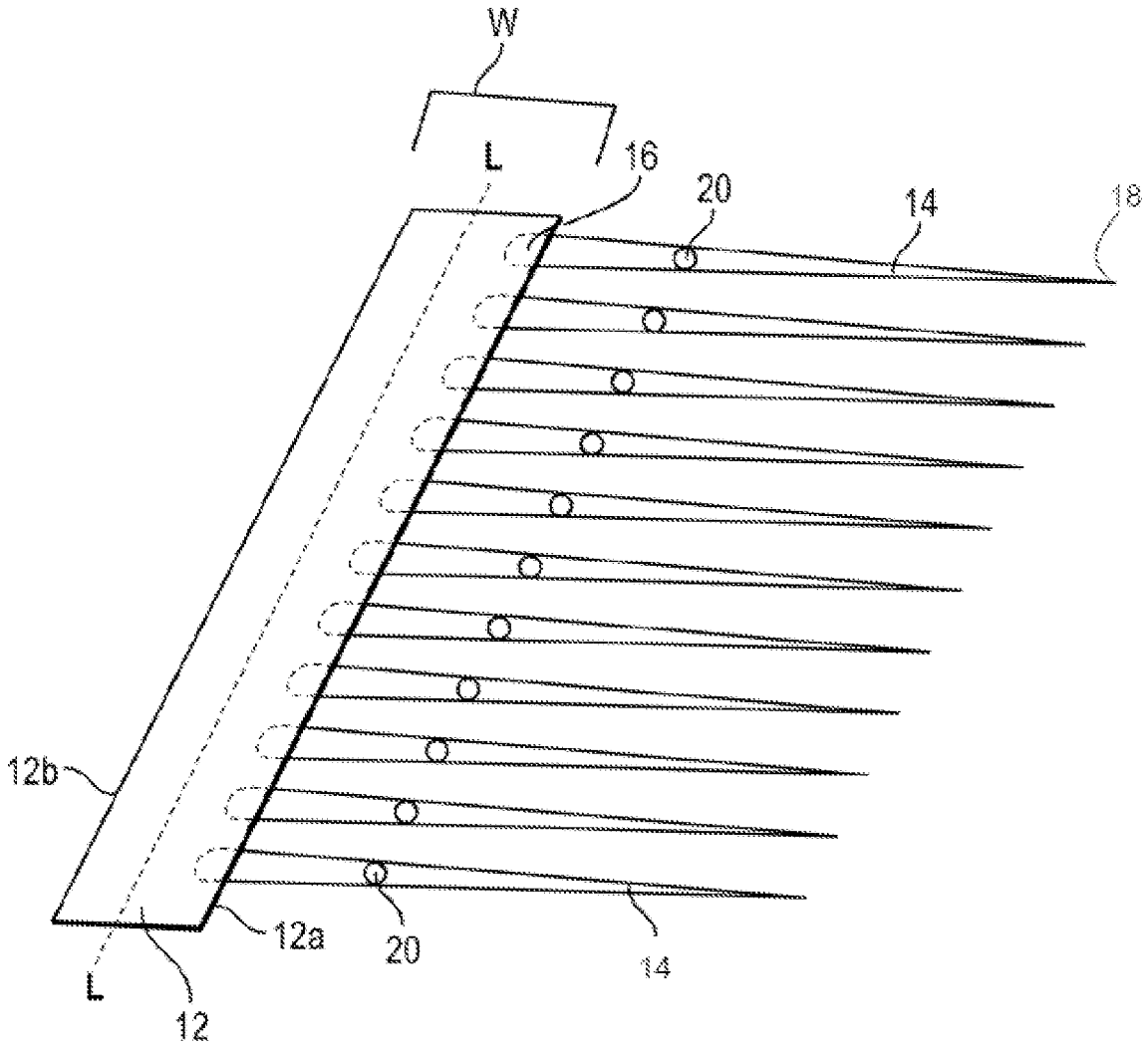
FIG. 1A depicts a perspective view of an artificial eyelash extension system having pre-applied adhesive elements in accordance with the features of the invention.

Turning to the figures, FIG. 1A depicts a perspective view of one embodiment 10 of the invented artificial eyelash extension system. The artificial eyelash extension system may include a plurality of artificial eyelash filaments, a support strip, and an adhesive element. The artificial eyelash extension system comprises a support strip 12 having a length L and width W. (The width W is a representation and not drawn to scale and may be narrower.) The support strip 12 may be attached to the bases of the eyelash filaments. The support strip 12 has a leading edge from which eyelash filaments 14 extend. The width W of the support strip 12 extends between the proximal 12*a* and distal 12*b* of the support strip 12. As shown in FIG. 1A, the artificial eyelash extension system 10 features eyelash filaments 14 extending between a base 16 and tip 18. The bases 16 of the eyelash filaments 14 are embedded within and/or adhered to the support strip 12. In the exemplary embodiment shown in FIG. 1A, the bases 16 of the eyelash filaments 14 are spaced apart, with the eyelash filaments 14 extending away from the support strip 12 such that the lengths of the eyelash filaments 14 are substantially parallel and extending in a direction that is substantially perpendicular to the length L of the support strip 12.

While in FIG. 1A, the width W of the support strip 12 is about ten percent of the length of the eyelash filaments 14; in other embodiments, the width W of the support strip 12 is much smaller than the eyelash filaments 14. For example, in some embodiments, the width W is less than five percent of the length of the eyelash filaments 14. The larger width W is shown only for illustration purposes and to be able to show the structure of the support strip 12.

As can be appreciated from FIG. 1A, the eyelash filaments 14 have a variable length and arrangement. Some eyelash filaments 14 are substantially parallel, while other eyelash filaments 14 cross each other. The eyelash filaments 14 will have an average length resulting in a desired overall appearance of length of the eyelashes after application, in one embodiment.

The eyelash filaments 14 are made from conventional materials used in eyelash extensions. Suitable materials include materials having an appearance similar to human eyelashes. Exemplary materials include mink, horsehair, human hair, synthetic materials, and combinations thereof.

Materials used in the support strip 12 are well known in the art and include any suitable material for the attaching of the bases of eyelash filaments 14. Exemplary materials include PBT, nylon, cotton, silk, and combinations thereof.

A salient feature of the invented artificial eyelash extension system 10 is the inclusion of an adhesive element 20 disposed on the eyelash filaments 14. The adhesive element 20 may be applied before the artificial eyelash extension system is packaged for sale to a user, to the plurality of the eyelash filaments. The adhesive element 20 may be applied at a position between the support strip and one-half the eyelash filaments' average length away from the support strip. The adhesive element 20 may be applied continuously to a predetermined location that is less than half of the eyelash filaments' average length away from the support strip. At least some of the adhesive element 20 is applied to the eyelash filaments 14 at the time of manufacturing of the system. FIG. 1A shows the adhesive element 20 disposed on each eyelash filament 14. The depiction of the location of the adhesive element 20 is meant to be exemplary and non-limiting. In the figures, the adhesive element 20 is shown as discrete droplets of adhesive. However, that depiction should not be limiting. While in FIG. 1A, all eyelash filaments 14 are shown with an applied adhesive element 20. In some embodiments, not all eyelash filaments 14 will receive adhesive. In one embodiment, between one-half and three-fourths of all eyelash filaments comprising the artificial eyelash extension system receive the adhesive element. In other embodiments, the plurality of eyelash filaments comprises multiple layers, and the adhesive may be applied to only one layer of eyelash filaments (e.g., the top layer), which comes in contact with the user's natural eyelash. However, even if the adhesive is applied to only the one layer of eyelash filament (e.g., the top layer), the adhesive may penetrate into the remaining layers.

A benefit of the adhesive element 20 is that the artificial eyelash extension system is ready to use without applying external adhesive, as will be described below.

While the figures depict the artificial eyelash extension system as being used in conjunction with a full-strip artificial eyelash extension system, the same ready-to-use adhesive concepts may be used in conjunction with artificial eyelash extension systems of various styles, lengths, and sizes, such as smaller "wisp" eyelash systems (e.g., KISS Falscara Eyelash made by Kiss Products, Inc. located in Port Washington, NY) that are segmented versions of a full-strip eyelash systems and whose support strip lengths are one-half to one-fifth of a full-strip eyelash extension system's support strip length, or even smaller "cluster" eyelash systems (e.g., KISS Lash Couture LuXtensions, also made by Kiss Products, Inc.), or the smallest "flare" or "individual" eyelash systems (e.g., KISS i•ENVY Ultra Black Flare Short/Medium/Long, KISS i•ENVY Ultra Black 3D Individual Lash Medium/Long, all of which are also made by Kiss Products, Inc.) that may include only a few eyelash filaments 14 attached together at their bases.

The adhesive element 20 can be disposed on a plurality of eyelash filaments 14 across the entire length L of the support strip 12 or some fraction of the eyelash filaments 14, such as two-thirds, one-half, or one-third. It will be apparent to one having ordinary skill in the art that the fraction of eyelash filaments 14 having the adhesive elements disposed thereon can be adjusted according to the weight of the section of artificial eyelash extension system 10 being used. For example, an artificial eyelash extension system 10 designed for application to all of a user's natural eyelashes may require that all the eyelash filaments 14 have corresponding adhesive elements. Alternatively, an artificial eyelash extension system 10 designed for attachment to some lesser portion of a user's natural lashes may only require that one half or a smaller proportion of eyelash filaments 14 bear corresponding adhesive elements. For example, the artificial eyelash extension system 10 can be a wisp, cluster, flare, or individual eyelash extension system.

As depicted in FIG. 1A, the adhesive element 20 can be discrete applications or droplets of an adhesive. The adhesive element 20 may be comprised of multiple discrete droplets of adhesive. The adhesive element 20 may be applied to an upward-facing surface of the eyelash filaments. In an embodiment, the adhesive element 20 is disposed at approximately the same position along the length of each eyelash filaments 14 away from the support strip 12. FIG. 1A shows the adhesive element 20 as small, flat sections of adhesive overlaying a portion of the eyelash filaments 14. In alternative embodiments, the adhesive element 20 may be non-cured droplets of adhesive.

Suitable adhesive elements for use in the instant invention include any adhesive that can be applied to the eyelash filaments 14 and retain stickiness while the artificial eyelash extension system 10 is stored in packaging. Suitable adhesive elements can be applied to eyelash filaments 14, then stored without drying.

Figure 1B:
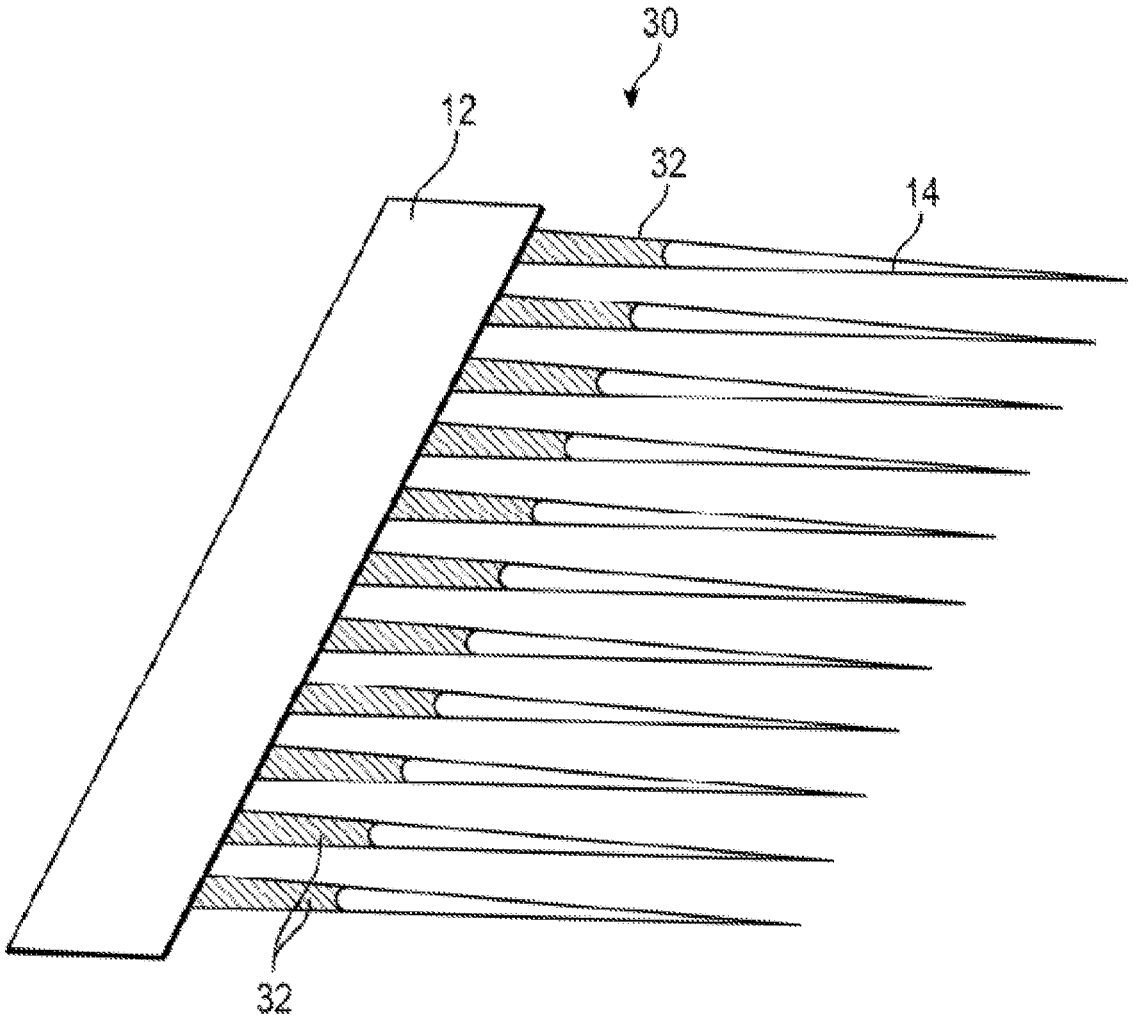
FIG. 1B depicts a perspective view of an alternative embodiment of an artificial eyelash extension system having pre-applied adhesive elements in accordance with the features of the invention.

FIG. 1A shows the adhesive element 20 as discrete applications of adhesive on the eyelash filaments 14. An alternative embodiment 30 is shown in FIG. 1B. The artificial eyelash extension system 30 shown in FIG. 1B features adhesive elements 32 extending continuously along the length of the eyelash filaments 14 starting from the support strip 12 to a defined position. In some embodiments, the length along the eyelash filaments 14 covered by the adhesive elements 32 is customized to the weight and other attributes of an artificial eyelash extension system using the invented system. Preferably, the adhesive elements 32 will extend continuously on the first half to one-third of the average length of the eyelash filaments that extend from the support strip (i.e., the length of the eyelash filament embedded in the support strip is not included in this length). In alternative embodiments, the adhesive elements 32 are disposed continuously along lengths of the eyelash filaments 14 where the length is not proximate to the support strip (i.e., middle and tip portions of eyelash filaments). Yet, in another embodiment, the adhesive elements 32 may be applied continuously from a position between the support strip 12 and one-half of the eyelash filaments' 14 average length. In other embodiments, the position is selected up to one-half of the eyelash filaments' average length from the support strip 12.

Figure 1C:
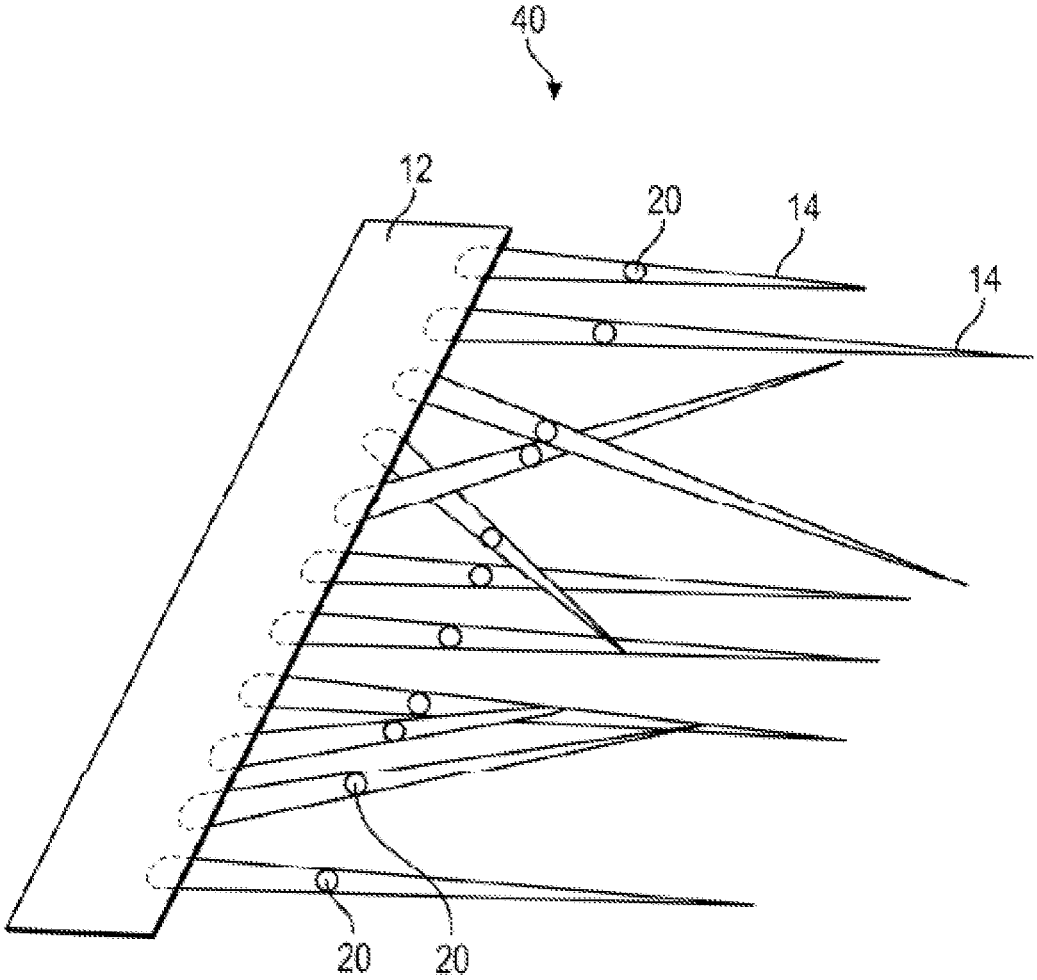
FIG. 1C depicts a perspective view of an alternative embodiment of an artificial eyelash extension system having pre-applied adhesive elements in accordance with the features of the invention.

FIGS. 1A and 1B show the eyelash filaments 14 in the same direction and having similar lengths. In alternative embodiments, such as the exemplary eyelash extension section 40 shown in FIG. 1C, the eyelash filaments 14 extend in different directions from the support strip 12 and can have different lengths. The eyelash filaments 14 may extend from the support strip 12 such that at least some of the eyelash filaments 14 overlap or cross one another. In one embodiment, the eyelash filaments 14 may extend from the support strip 12 such that at least one-quarter of the eyelash filaments 14 overlap or cross one another. The embodiment shown in FIG. 1C can utilize both the continuous and discrete applications of adhesive elements 14 shown in FIGS. 1A and 1B.

Figure 1D:
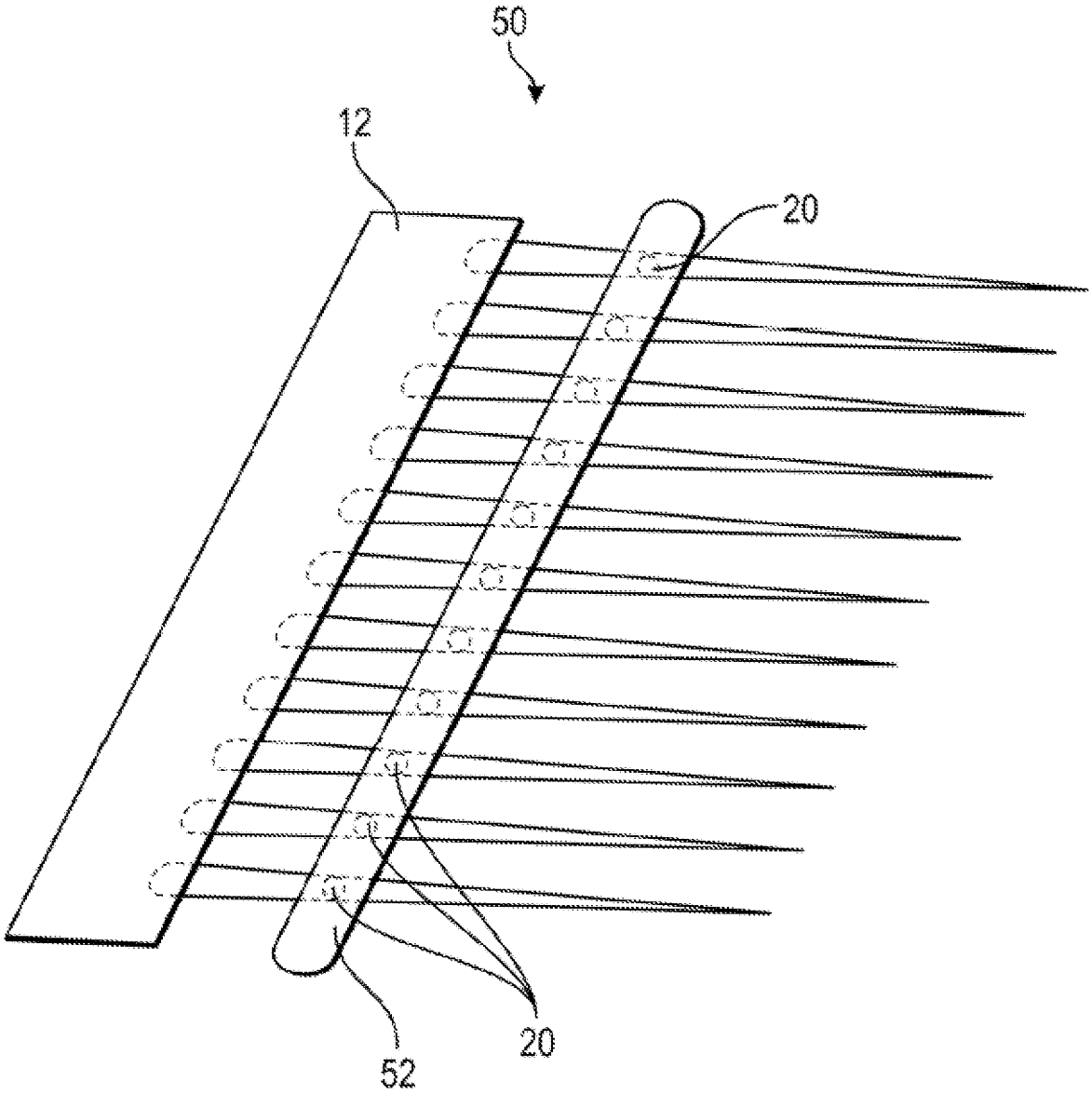
FIG. 1D depicts a perspective view an embodiment of an artificial eyelash extension system having pre-applied adhesive elements overlaid by a temporary backing in accordance with the features of the invention.

FIG. 1D shows yet another embodiment 50 of the invented artificial eyelash extension system. In this embodiment, the adhesive elements (20 or 32 above) are overlaid with an elongated substrate 52. The elongated substrate 52 may further include removably overlaying the adhesive elements 20. The elongated substrate 52 is a thin piece of material that is in removable contact with the adhesive elements 20 disposed on the eyelash filaments 14. The elongated substrate 52 of the adhesive elements 20 maintains the cleanliness of the adhesive elements 20 on the artificial eyelash extension system 50 before a user is ready to apply the artificial eyelash extension system 50 and prevents the artificial eyelash extension system 50 from tangling or getting stuck to undesired surfaces or objects.

In the embodiment depicted in FIG. 1D, the bond between the eyelash filaments 14 and the adhesive elements 20 is stronger than the bond between the adhesive elements 20 and the elongated substrate 52. This relationship of bond strength corresponds with the ability of a user to peel off the elongated substrate 52 from the adhesive elements 20 without removing the adhesive elements 20 from the eyelash filaments 14 or otherwise damaging the artificial eyelash extension system 50.

In an embodiment, the strength of the adhesion between the adhesive elements 20 and the elongated substrate 52 is tuned by selecting the thickness of an adhesive applied to the surface of the elongated substrate 52 that contacts the adhesive elements 20. Using particular adhesives on the elongated substrate 52, applying a thin layer of adhesive allows for easy removal of the elongated substrate 52 from the adhesive elements 20, while a thicker layer of adhesive will increase the strength of the bond between the elongated substrate 52 and the adhesive elements 20.

In another embodiment, the strength of the adhesion between the adhesive elements 20 and the elongated substrate 52 is tuned by applying a pre-glue (an adhesive that does not completely coalesce during storage of the stored artificial eyelash extension system) to the surface of the elongated substrate 52 that is in contact with the adhesive elements 20.

FIGS. 1A-D show the adhesive elements applied on an upward-facing surface of the eyelash filaments 14 of an artificial eyelash extension system. In these configurations, the invented artificial eyelash extension system is removably attached to the underside of a user's natural lashes. In alternative embodiments, the adhesive elements are disposed on a downward-facing surface of the eyelash filaments 14 of an artificial eyelash extension system. In this alternative embodiment, the artificial eyelash extension system can be removably attached to the top of a user's natural eyelashes.

Figure 2A:
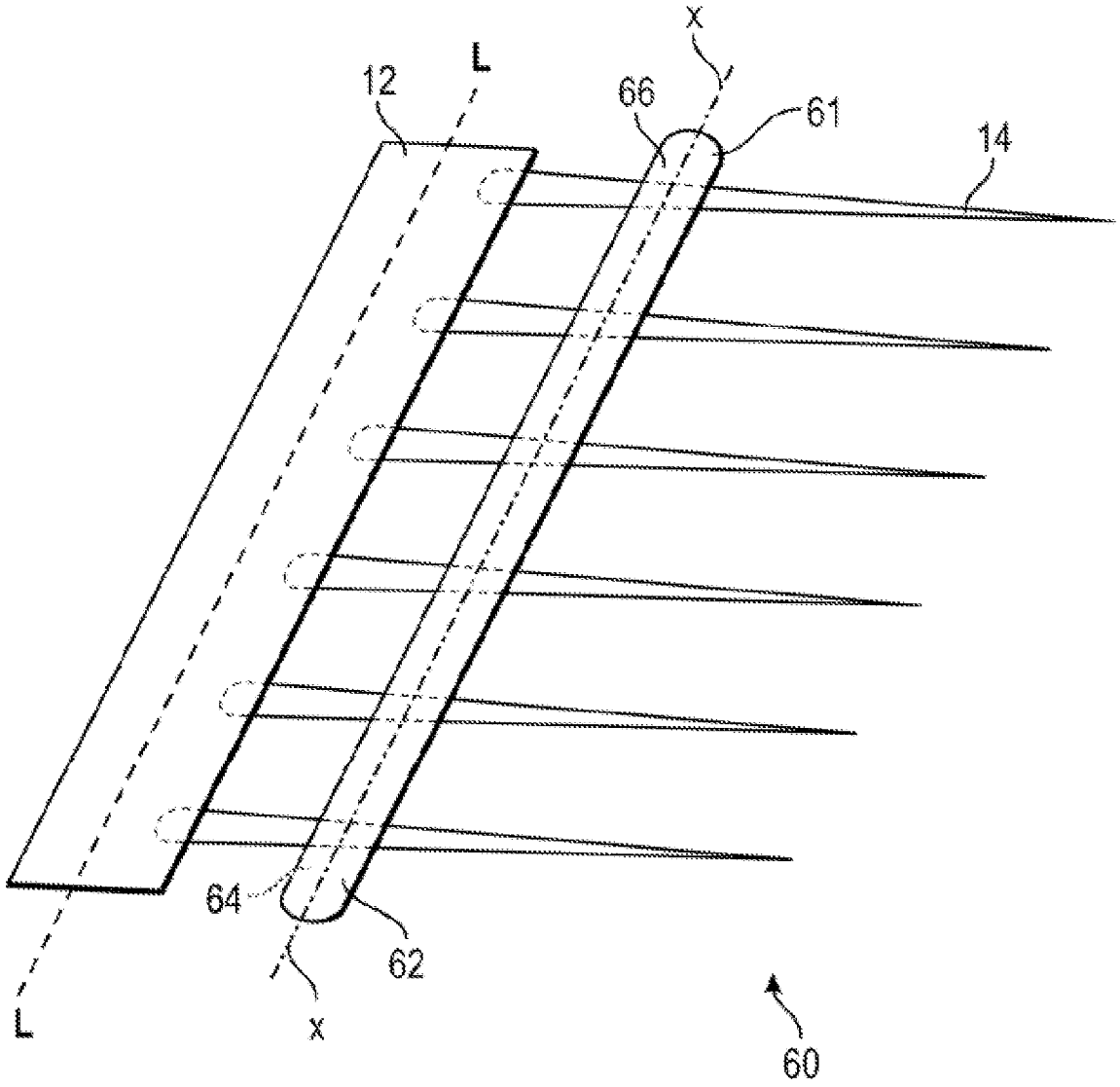
FIG. 2A depicts a perspective view of an embodiment of an artificial eyelash extension system having an alternative pre-applied adhesive element in accordance with the features of the invention.

FIG. 2A shows another embodiment 60 of the invented artificial eyelash extension system. This embodiment 60 features the same configuration of eyelash filaments 14 and support strip 12 as the embodiment shown in FIG. 1A. In this embodiment, however, the adhesive element 61 in this embodiment 60 is an elongated substrate 62 disposed across the eyelash filaments 14 such that the longitudinal axis x of the elongated substrate 62 is parallel with the length L of the support strip 12. The elongated substrate 62 may also be shorter than the length L of the support strip 12.

As shown in FIG. 2A, the elongated substrate 62 is disposed across the eyelash filaments 14 in a direction perpendicular to the length of the eyelash filaments 14. The adhesive element 61 may comprise an elongated substrate 62 having a longitudinal axis, an upward-facing surface 66, a downward-facing surface 64, and an adhesive disposed on the upward-facing and downward-facing surfaces 66 and 64, wherein the adhesive on the downward-facing surface 64 contacts the eyelash filaments 14. The adhesive used on the upward-facing and downward-facing surfaces 66 and 64 of the elongated substrate 62 may be different. The lash extension system or artificial eyelash extension system may be adapted for the removal of the elongated substrate 62 from the user's eyelashes without removing the elongated substrate 62 from the eyelash filaments 14. The downward-facing surface 64 of elongated substrate 62 is secured to the eyelash filaments 14. The upward-facing surface 66 of the elongated substrate 62 features an adhesive or other sticky substance disposed thereon.

A person having ordinary skill in the art will readily appreciate that the elongated substrate 62 can be positioned across the eyelash filaments 14 anywhere along their length. Preferably, the elongated substrate 62 is positioned with its centerline (line x in FIG. 2A) disposed on the eyelash filaments 14 at a position corresponding to one-third to one-half of the length of the eyelash filaments 14 extending from the support strip 12. This positioning of the elongated substrate 62 is exemplary and not meant to be limiting. The elongated substrate 62 can reasonably be positioned over any portion of the eyelash filaments 14.

The elongated substrate 62 can be any suitable material for overlaying the eyelash filaments 14 without overly weighing down the lashes and without bending the lashes when worn by a user. Suitable materials for the elongated substrate 62 include double-sided tape and other types of thin strips with adhesives applied to both sides.

A salient feature of this embodiment is the ability of a user to obtain the artificial eyelash extension system 60 and use it without applying their own adhesives either to the artificial eyelash extension system or their lashes. To enable this feature, the artificial eyelash extension system 60 has to be ready to use when desired by a user. As such, the artificial eyelash extension system 60 should not be stuck to undesired surfaces or objects and should feature clean adhesive disposed on the upward-facing surface 66 of the elongated substrate 62. In order to maintain the artificial eyelash extension system 60 in a ready-to-use configuration, a backing (second elongated substrate) 72 is removably secured to the adhesive distributed over the upward-facing surface 66 of the elongated substrate 62. The embodiment 60 overlaid by the backing 72 is shown in the embodiment 70 shown in FIG. 2B. This backing 72 is a temporary overlayment on the adhesive on the upward-facing surface 66 of the elongated substrate 62 that prevents the artificial eyelash extension system 60 from sticking to undesired objects or becoming entrained with debris that would undermine the stickiness or appearance of the adhesive.

The backing 72 is double-sided in one embodiment. The backing 72 can be removably secured to the adhesive distributed over the upward-facing surface 66 of the elongated substrate 62, can be made from any material suitable for the temporary overlayment of the adhesive on the elongated substrate 62. Suitable materials include paper, plastic, fiber, and combinations thereof.

In an embodiment featuring the backing 72, the bond between the backing 72 and the first elongated substrate 62 is weaker than the bond between the first elongated substrate 62 and the eyelash filaments 14. This can be accomplished by, for example, forming a permanent or semi-permanent bond between the first elongated substrate 62 and the eyelash filaments 14 and a temporary or removable bond between the backing 72 and the first elongated substrate 62. Alternatively, the adhesive contacting surface of the backing 72 is scored, frosted, or otherwise treated to prevent over sticking. These configurations are exemplary and not meant to be limiting. A person having ordinary skill in the art will understand that any configuration is suitable wherein the second elongated substrate (backing 72) can be removed from overlayment of the first elongated substrate 62 without ripping the first elongated substrate 62 from the eyelash filaments 14.

Figure 2B:
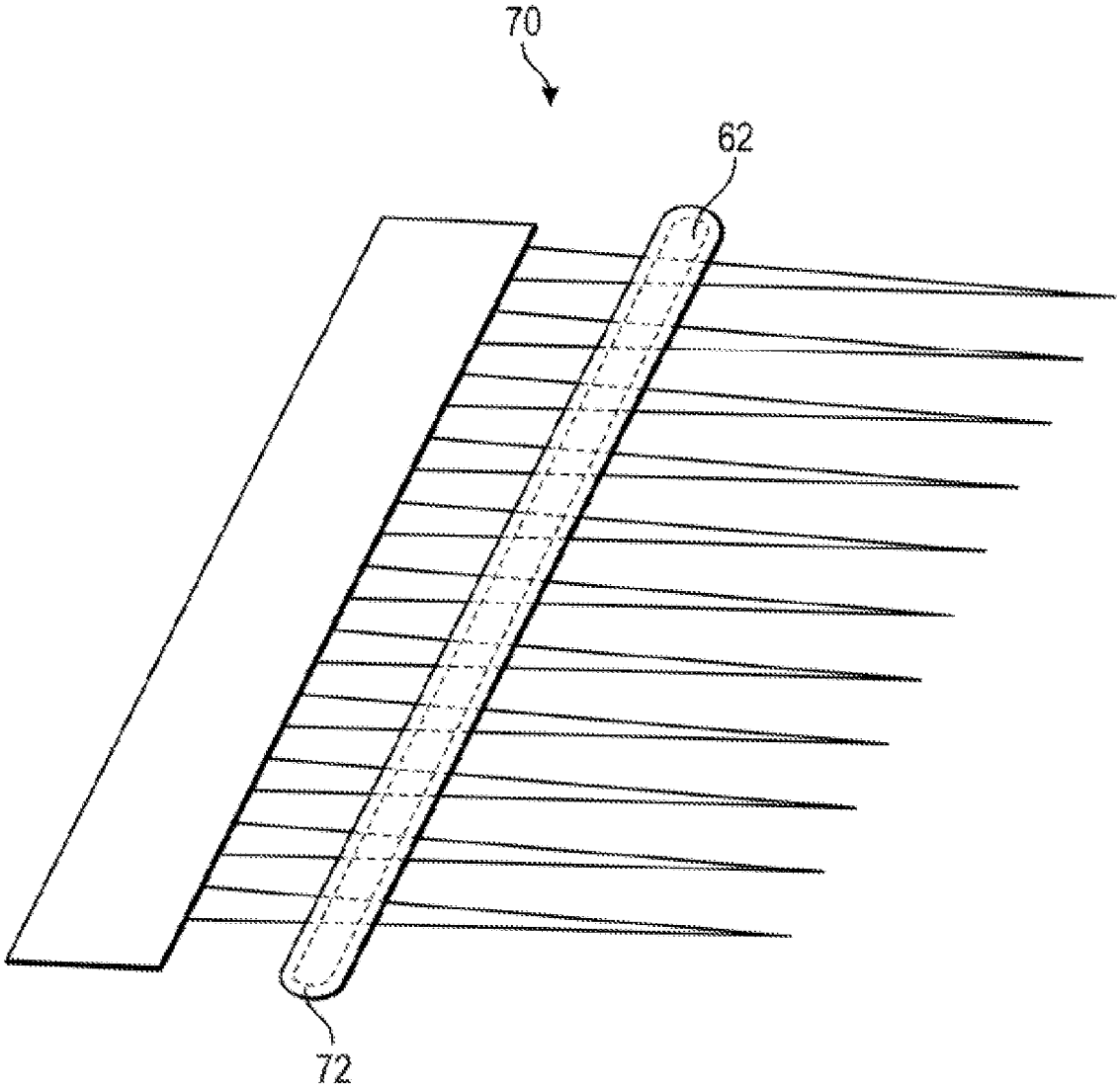
FIG. 2B depicts a perspective view of the invention embodiment shown in FIG. 2A featuring a temporary overlayment of the adhesive elements in accordance with the features of the invention.
Figure 2C:
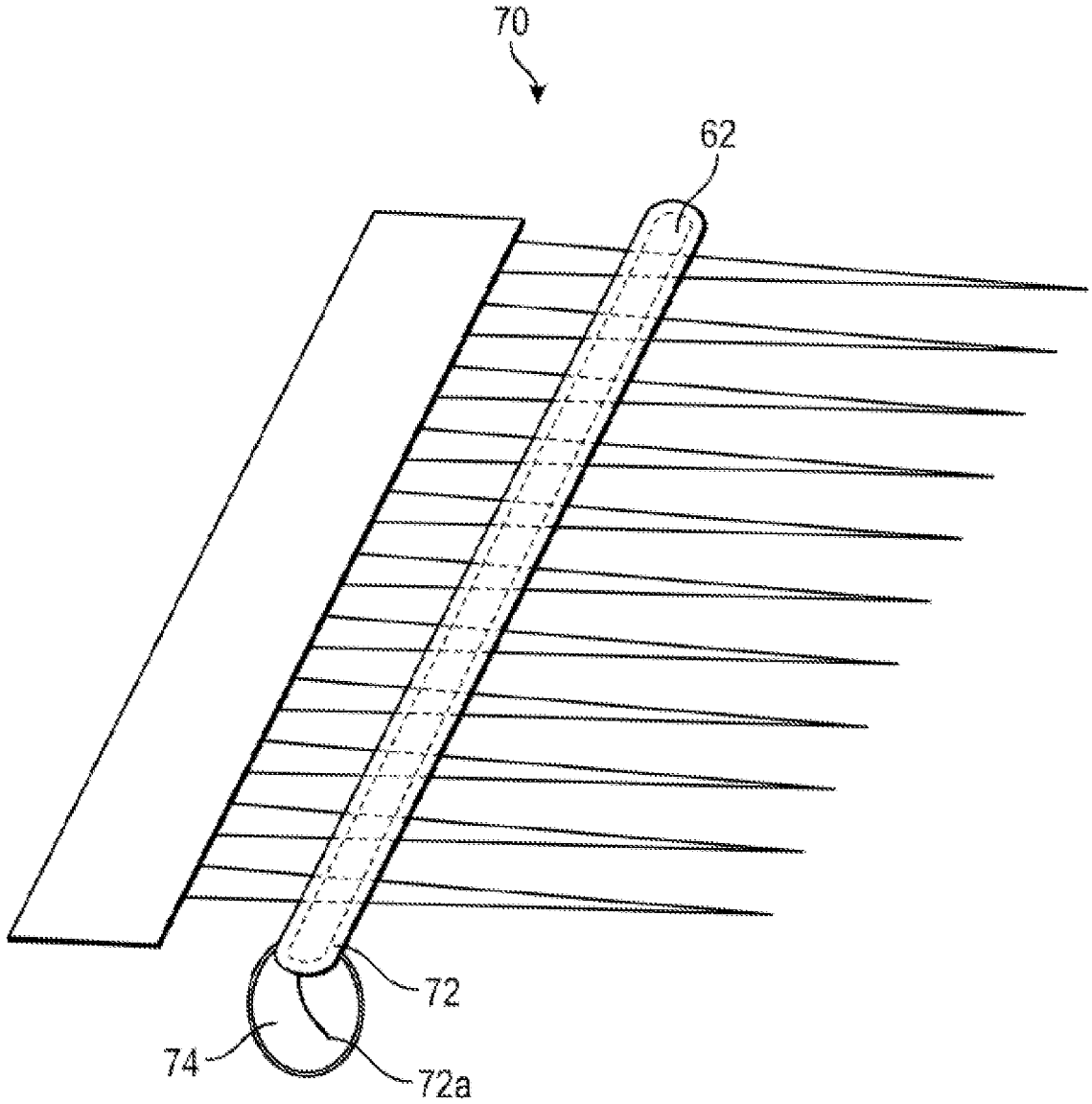
FIG. 2C depicts a perspective view of the invention embodiment shown in FIG. 2B featuring an alternative embodiment of temporary overlayment of the adhesive elements, in accordance with the features of the invention.

FIG. 2C shows the invented artificial eyelash extension system 70 shown in FIG. 2B with the addition of an element that facilitates the removal of the backing 72 from the elongated substrate 62. As shown in FIG. 2C, the backing 72 can feature a terminating end 72*a* that extends past the periphery of the artificial eyelash extension system and defines a tab 74. The tab 74 of the backing 72 can be the same shape as the rest of the backing 72. Alternatively, as shown in FIG. 2C, the tab 74 of the backing 72 can feature a different and larger shape, such as a circular shape that gives a user a larger area to grab. In use, a user can grab the tab 74 and pull it toward the opposing end of the backing 72 to remove the backing 72 from the artificial eyelash extension system 70.

Figure 3A:
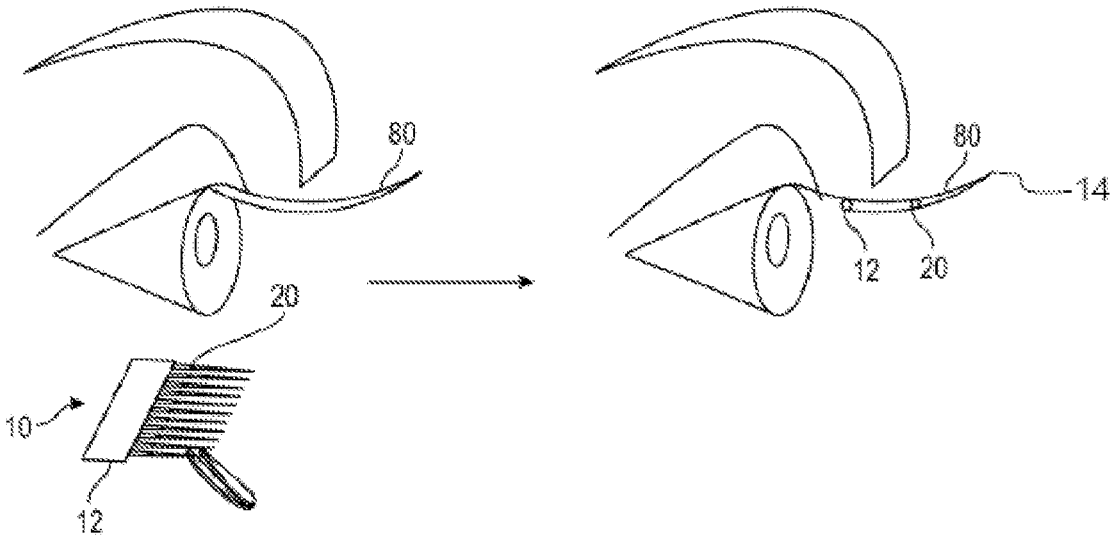
FIG. 3A depicts a schematic of using the artificial eyelash extension system depicted in FIG. 1A in accordance with the features of the invention.

FIG. 3A depicts a schematic of a method of using the embodiment of the invention featured in FIG. 1A. The method for applying artificial eyelash extension systems may comprise providing to a user an artificial eyelash extension system already having an adhesive element disposed on the eyelash extension system before being packaged for sale to the user and moving the adhesive element of artificial eyelash extension system into contact with the user's natural eyelashes. The step of moving the adhesive element of the artificial eyelash extension system into contact with the user's natural eyelashes may comprise contacting an underside of the user's natural eyelashes with the adhesive element disposed on the upward-facing surface of the elongated substrate. In the method, the user grasps the tip 18 of eyelash filaments 14 and positions the artificial eyelash extension system 10 under the natural eyelashes 80 to receive the artificial eyelash extension system 10. The natural eyelashes 80 are the user's eyelashes in the depicted embodiment. The user then moves the artificial eyelash extension system 10 upward so that the adhesive elements 20 of the eyelash filaments 14 contact the user's natural eyelashes 80.

The adhesive elements 20 of the artificial eyelash extension system 10 can contact any portion of the underside of a user's natural eyelashes 80. Preferably, the adhesive elements 20 of the artificial eyelash extension system 10 are put into contact with the user's natural eyelashes 80 such that the support strip 12 of the artificial eyelash extension system underlies the underside of a user's natural eyelashes 80 or their eyelid.

A user applying any of the embodiments of the artificial eyelash extension system described herein using an eyelash applicator such as the KISS Falscara Eyelash Applicator made by Kiss Products, Inc., located in Port Washington, New York. The Kiss applicator is one suitable eyelash applicator for use with the instant invention and is not meant to be limiting. A person having ordinary skill in the art will understand that many false lash applicators are suitable for use with the instant invention. Alternatively, a user may use their hand to grasp the invented artificial eyelash extension system and move it into contact with the user's natural lashes.

A salient feature of the instant invention is its ready-to-use nature. Prior art lash systems require applying a bonding solution to the artificial eyelash extensions and/or the natural lashes of a user before application. The pre-applied adhesive elements are suitable for immediate application to a user's lashes without further preparation of the artificial eyelash extension system or the user's natural eyelashes.

After moving the artificial eyelash extension system into contact with their natural eyelashes, the invented artificial eyelash extension system will stay in place without any further pressing using their hand or an applicator. Further, no additional bonding solutions need to be applied. Once the invented artificial eyelash extension system is in place, the user can optionally use the applicator or hand to adjust the precise position of the artificial eyelash extension system or firmly squeeze the adhesive elements and natural eyelashes together. Surprisingly and unexpectedly, the inventors have discovered that the step of firmly pressing together their natural eyelashes and adhesive elements from the artificial eyelash extension system is not necessary as it was in prior art systems. Similarly, the instant invention does not require the sandwiching of natural eyelashes between an artificial eyelash extension system on the top of the lashes and one on the bottom of the lashes in order to form a lasting bond as is found in the prior art. Another significant feature of the instant invention is that the artificial eyelash extension systems described herein can be applied using only one hand.

Use of Lash Extensions

FIG. 3A shows a general schematic for using the invented artificial eyelash extension system once the adhesive elements are exposed. The embodiment shown in FIG. 1D, for example, first requires the removal of the temporary overlayment of its adhesive elements prior to adhering the artificial eyelash extension system to the natural eyelashes of a user. A benefit of the artificial eyelash extension system is that the extension can be worn without the application of additional adhesive.

Figure 3B:
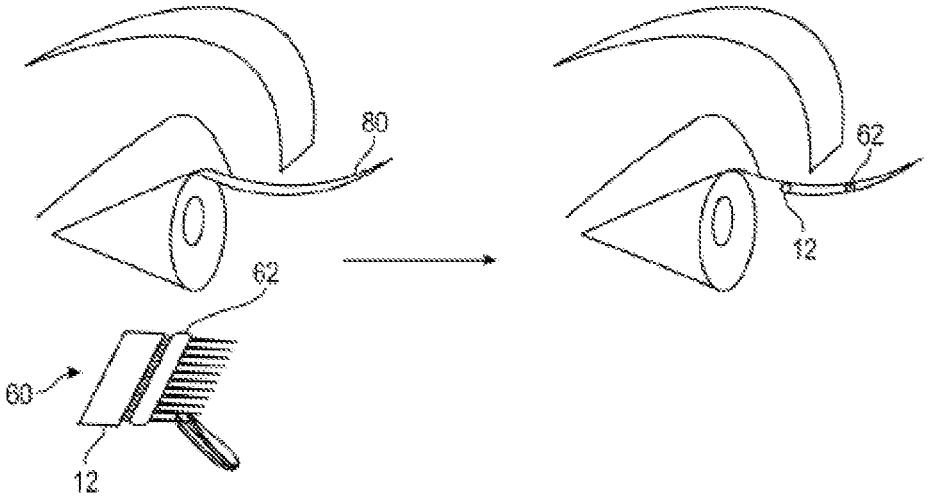
FIG. 3B depicts a schematic of using the artificial eyelash extension system depicted in FIG. 2A in accordance with the features of the invention.

FIG. 3B shows a schematic of a method of using the embodiment of the artificial eyelash extension system shown in FIG. 2A. Similar to the schematic shown in FIG. 3A, the application of the artificial eyelash extension system shown in FIG. 2A only requires one step, grasping the end of the eyelash filaments with a hand or applicator and moving the adhesive elements into contact with the desired portion of a user's natural eyelashes.

The adhesive element may further include a second elongated substrate temporarily overlaying the adhesive element disposed on the upward-facing surface of the elongated substrate, and wherein that second elongated substrate is removed before moving the adhesive element of the artificial eyelash extension system into contact with the user's natural eyelashes. Where the adhesive elements of the artificial eyelash extension system shown in FIG. 2B are overlaid with a backing (second elongated substrate), the backing is removed prior to application of the artificial eyelash extension system to a user's natural eyelashes.

After the application step in FIGS. 3A, and 3B, the user wears the invented artificial eyelash extension system for a period of up to 24 hours. After wear, the user then grasps the unattached end of the worn artificial eyelash extension system and gently pulls downward in order to remove the artificial eyelash extension system from their eyelashes. The artificial eyelash extension systems can then be stored for reuse. The artificial eyelash extension systems, once removed, can be reused until their associated adhesive elements wear out. Alternatively, the original adhesive elements of the invented artificial eyelash extension system can be rejuvenated or removed and replaced with new adhesive elements. Where a user removes the original adhesive elements from the invented artificial eyelash extension system, the stripped system can then continue to be used as an artificial eyelash extension system wherein a user applies their own glue.

The figures show the artificial eyelash extension system having a length that approximates the length of a user's eyelid. This is exemplary and not meant to be limiting. In an embodiment, a user will apply only one artificial eyelash extension system that removably underlies all or substantially all of a user's natural eyelashes. In such an embodiment, a user needs only apply one artificial eyelash extension system to their natural eyelashes. In alternative embodiments, the length of the support strips will be shorter and will require a user to apply more than one artificial eyelash extension system in order to removably underlie all or substantially all their eyelashes. In yet another embodiment, a user will cut a longer strip of artificial eyelash extension systems into a plurality of artificial eyelash extension systems having desired lengths, forming a cluster of artificial eyelash extension systems.

In one embodiment, the steps of use include applying additional glue, drying, and applying heat. The heat-activated adhesive becomes more pliant when heated. In this embodiment, the users will apply heat by using a heat applicator. In one embodiment, the heat applicator is a small heater included in the package. In another embodiment, the source of heat is a force-activated heat pack. In another embodiment, the heat source comprises a layer of material that heats up when exposed to the electromagnetic radiation found in a microwave oven.

When dried on the eyelash filaments, the glue is substantially solid. When heated, the glue changes states to a somewhat liquid or soft-jello-like, jelly-like, or pudding-like state. While in this state, the application to natural eyelashes is more comfortable.

Figure 4A:
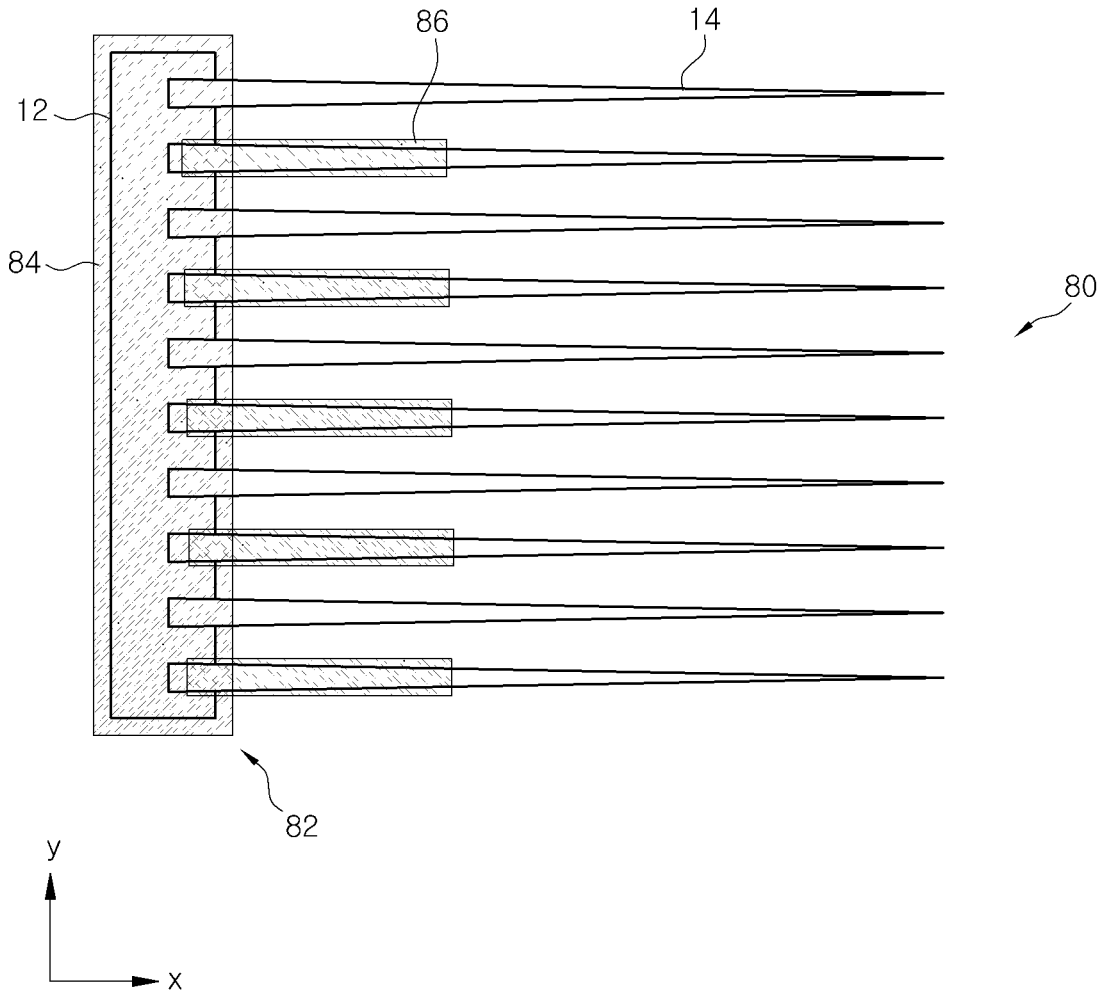
FIGS. 4A-4K depict plan views of alternative embodiments of artificial eyelash extension systems having adhesive elements in accordance with the features of the invention.

Alternative Embodiments of Artificial Eyelash Extension System Having Adhesive Element FIG. 4A shows another embodiment of an invented artificial eyelash extension system having an adhesive element. The artificial eyelash extension system 80 of this embodiment features the same configuration of eyelash filaments 14 and support strip 12 as the embodiment shown in FIG. 1A. In this embodiment, however, an adhesive element 82 having a fork shape including a head 84 and a plurality of spears 86 is disposed on the artificial eyelash extension system 80. As shown in FIG. 4A, the head 84 of the adhesive element 82 is disposed to cover one side of the support strip 12 along the longitudinal direction of the support strip 12 (i.e., y-axis). Further, in FIG. 4A, a plurality of spears 86 are disposed to cover one side of the eyelash filaments 14 along the longitudinal direction of the eyelash filaments 14 (i.e., x-axis). The adhesive element 82 having the head 84 and the plurality of spears 86 may be configured as a single adhesive substrate. Otherwise, the adhesive element 82 may be configured as separate adhesive substrates combined. In one embodiment (not shown), the head 84 and respective spears 86 may each be a single adhesive substrate separated from each other. In another embodiment (not shown), separate adhesive substrates, which respectively include one or more of spears 86 and a part of the head 84, may be combined to form the adhesive element 82.

The adhesive element 82 may be any suitable adhesive material, such as, for example, a doubled-sided tape, a glue sticker, etc. The adhesive element 82 has an upward-facing surface and a downward-facing surface, wherein the downward-facing surface contacts the eyelash filaments 14. Further, the downward-facing surface has an adhesive property that can be secured to the support strip 12 and/or the eyelash filaments 14, and the upward-facing surface has an adhesive property that can be put in contact with the user's natural eyelashes such that the artificial eyelash extension system 80 can adhere to a user's natural eyelashes (e.g., the underside of the user's natural eyelashes). In one embodiment, the strength of adhesion of the upward-facing surface and the strength of adhesion of the downward-facing surface may be same or different. For example, the strength of adhesion of the upward-facing surface and the strength of adhesion of the downward-facing surface may be determined such that the adhesive element 82 does not detach from the artificial eyelash extension system 80 while allowing the user to easily wear or remove the artificial eyelash extension system 80 from the user's natural eyelashes without applying their own adhesives either to the artificial eyelash extension system 80 or the user's natural eyelashes.

The x-axis dimension and the y-axis dimension of the head 84 and the x-axis dimension and the y-axis dimension of the spear 86 are not limited to those illustrated in FIG. 4A, and they may be variously determined according to the particular style of an artificial eyelash extension system. For example, the x-axis dimension or the y-axis dimension of the head 84 may be less than, respectively, the x-axis dimension or the y-axis dimension of the support strip 12. Further, the x-axis dimension of the spear 86 may be greater than the x-axis dimension of some of the eyelash filaments 14. Although FIG. 4A shows that the adhesive element 82 comprises four spears 86, the present embodiment is not limited thereto, and the adhesive element 82 may comprise any number of spears 86.

The adhesive element 82 may be manufactured, packaged, transported and stored separately from the artificial eyelash extension system 80 prior to being combined with the artificial eyelash extension system 80. That is, during the manufacturing process, the adhesive element 82 is combined with an artificial eyelash extension system 80 so that users can wear it without applying their own adhesive. This process will be described in detail with reference to FIGS. 5A and 5B.

FIGS. 4B-4K are diagrams showing various other embodiments of the artificial eyelash extension systems having adhesive elements. For simplicity, portions overlapping with those described above with reference to FIG. 4A will be omitted, but the omitted portions can be similarly applied to the below embodiments of FIGS. 4B-4K.

Figure 4B:
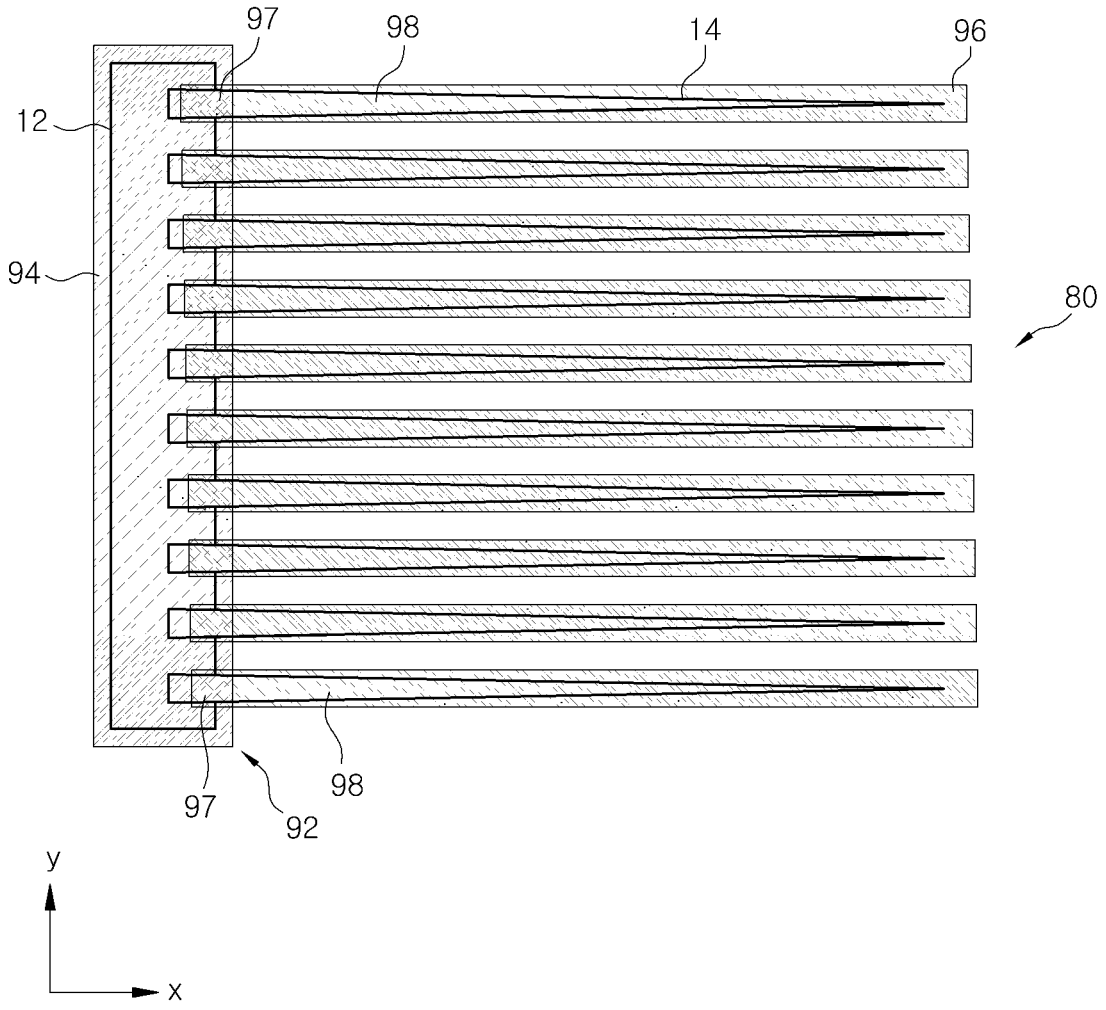

FIG. 4B shows an embodiment having a same configuration as that of FIG. 4A except that a plurality of spears 96 included in an adhesive element 92 are disposed along the y-axis dimension of the support strip 12 so that the roots 97 of the eyelash filaments 98 at both ends of the support strip 12 are covered by the spears 96. As mentioned above in FIG. 4A, the x-axis dimension and the y-axis dimension of the head 94 and the x-axis dimension and the y-axis dimension of the spear 96 are not limited to those illustrated in FIG. 4B, and they may be variously determined according to the particular style of an artificial eyelash extension system. For example, although FIG. 4B shows that the x-axis dimension of the spear 96 is greater than that of the eyelash filament 14, the embodiment is not limited thereto, and the x-axis dimension of the spear 96 may be less than that of the eyelash filaments 14.

Figure 4C:
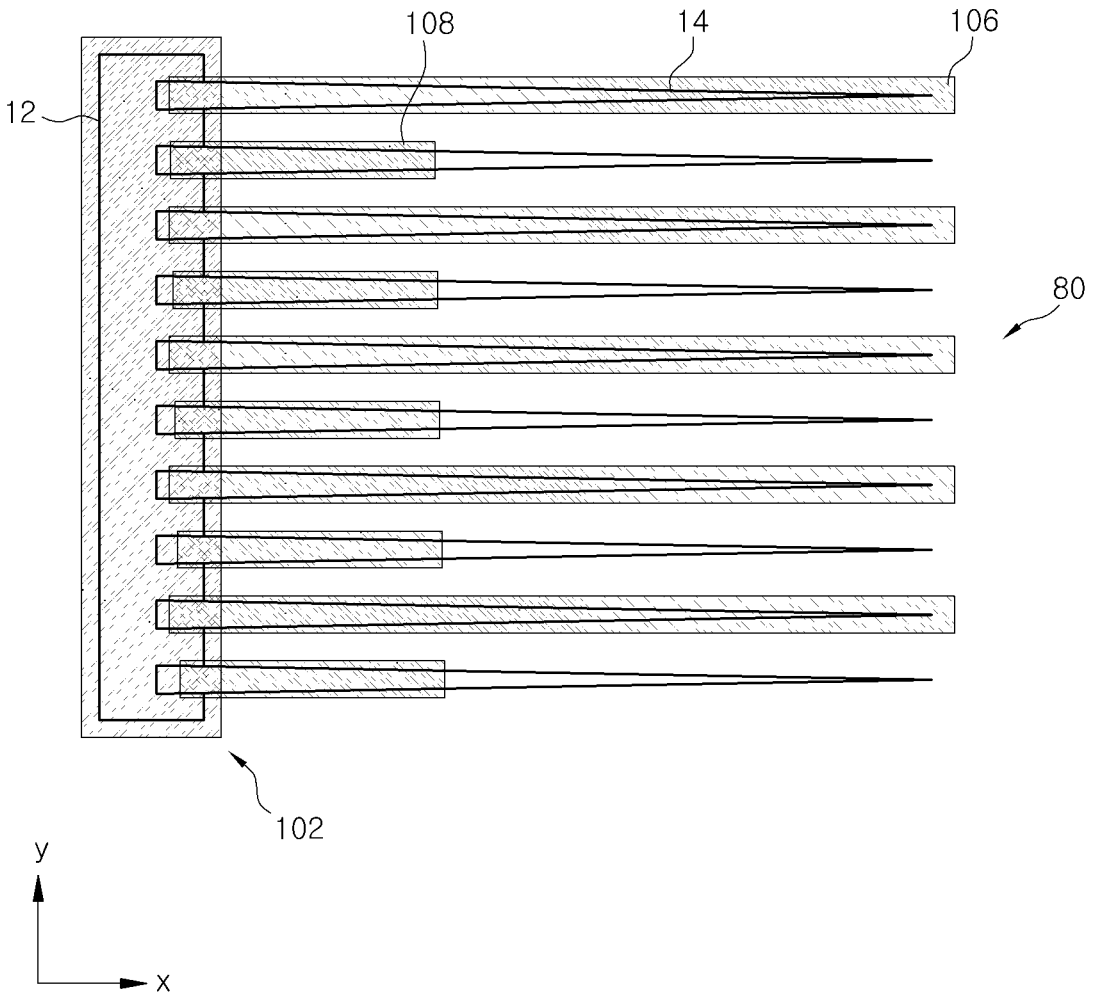

FIG. 4C shows an embodiment, in which an adhesive element 102 has spears 106, 108 of various lengths. The adhesive element 102 is configured by alternatively arranging long spears 106 having the first length and short spears 108 having the second length on the eyelash filaments 14, wherein the first length is longer than the second length in x-axis. The ratio of the numbers of the long spear 106 and the short spear 108 illustrated in FIG. 4C is merely an example, and the present embodiment is not limited thereto, and the ratio of the numbers of the long spear 106 and the short spear 108 may be variously determined according to the particular style of an artificial eyelash extension system. Likewise, there may be two or more spears of a certain length followed by two or more spears or another length (e.g., FIGS. 4D and 4E), multiple spears of multiple lengths, or any other arrangement where the spears have varying lengths from one another.

Figure 4D:
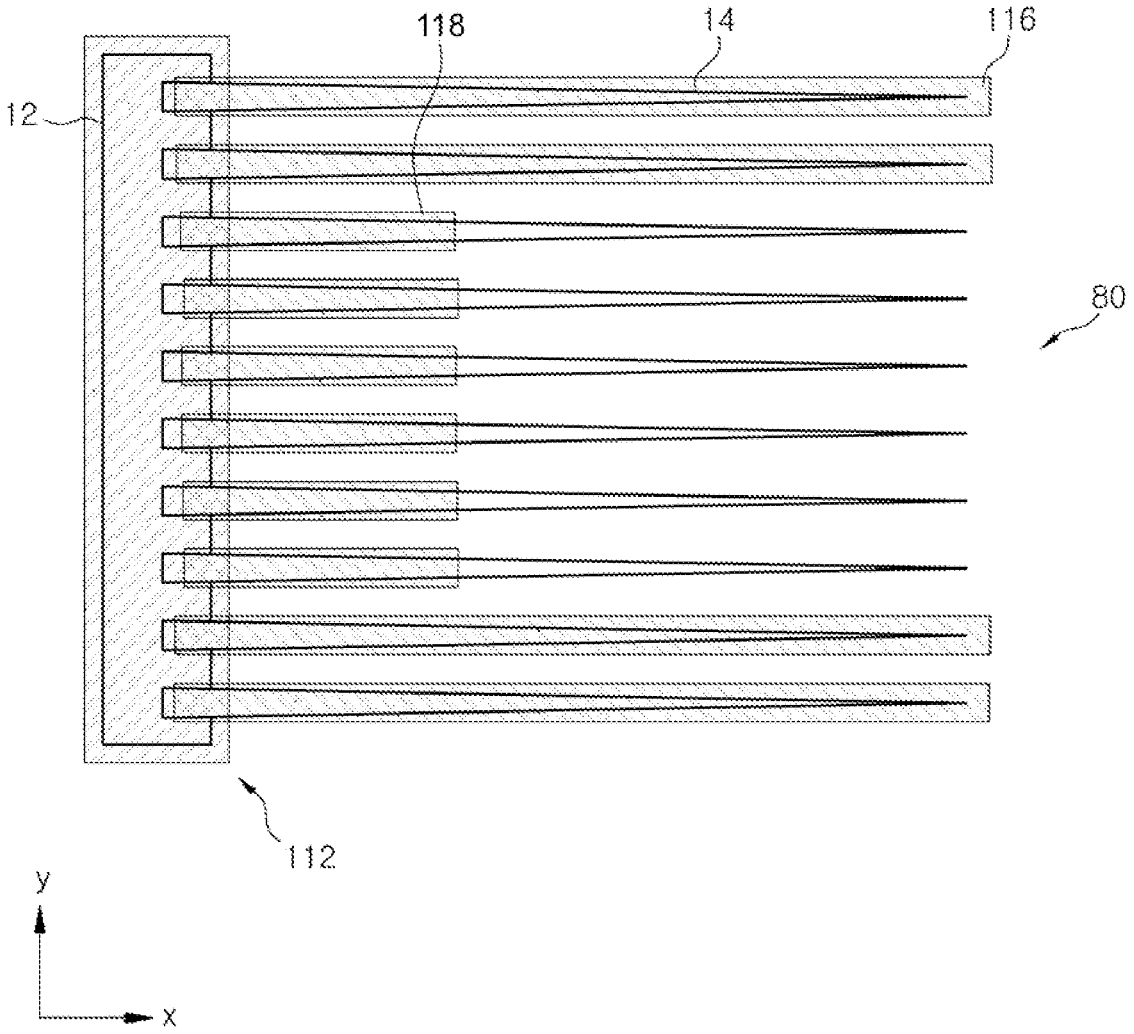

FIG. 4D shows an embodiment, in which an adhesive element 112 is configured to form the arch shape as a whole by appropriately arranging long spears 116 having the first length and short spears 118 having the second length on the eyelash filaments 14, wherein the first length is longer than the second length in x-axis. The number and arrangement of the long spears 116 and the short spears 118 are not limited to the those illustrated in FIG. 4D, and the long spears 116 and the short spears 118 may be arranged with various modifications, including the adhesive element 112 shown in FIG. 4D, which forms the arch shape as a whole.

Figure 4E:
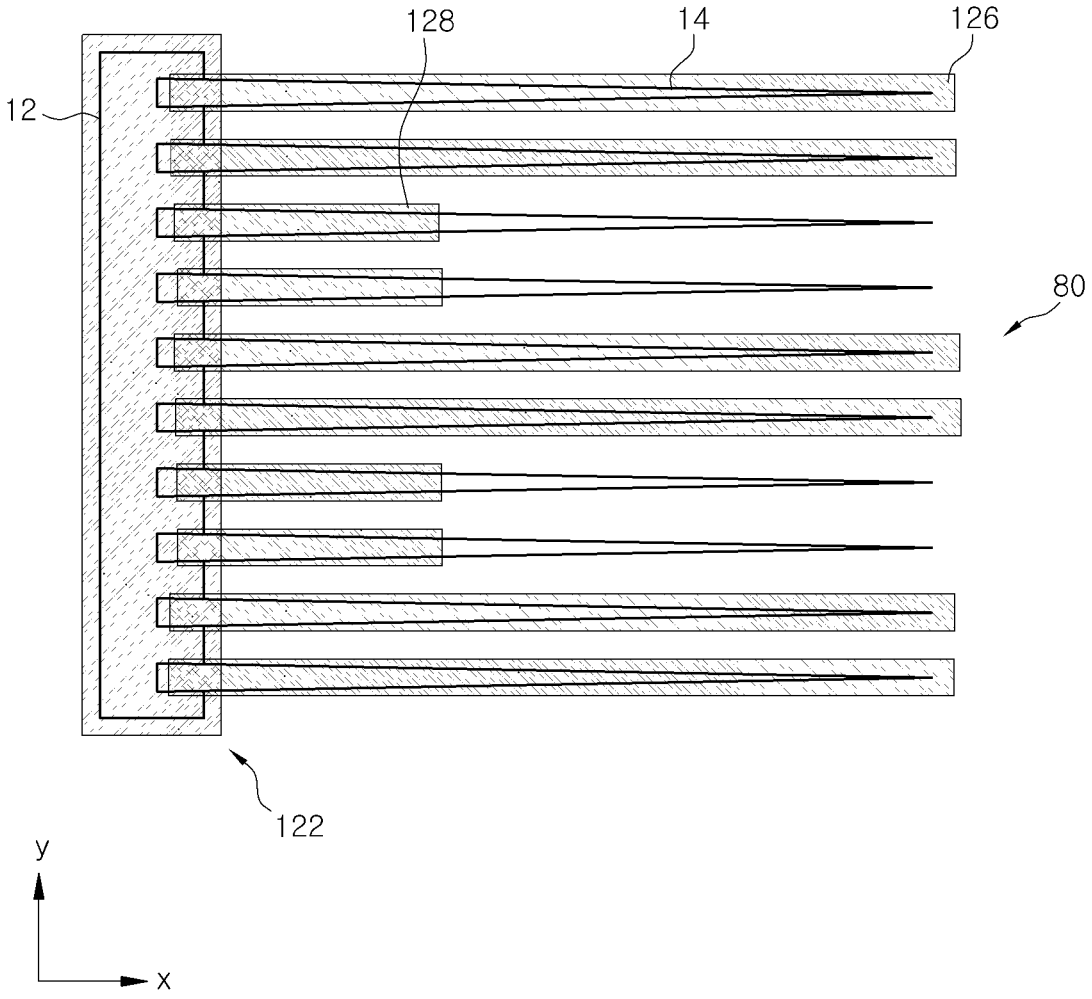

FIG. 4E shows an embodiment, in which an adhesive element 122 is configured by alternately arranging a group of long spears 126 having the first length and a group of short spears 128 having the second length on the eyelash filaments 14, wherein the first length is longer than the second length in x-axis. The groups of long spears 126 are arranged on the eyelash filaments 14 of both edges of the artificial eyelash extension system 80. In FIG. 4E, although the long spears 126 and the short spears 128 are grouped by two, the present embodiment is not limited thereto, and they may be grouped in various numbers according to an exemplary embodiment.

Figure 4F:
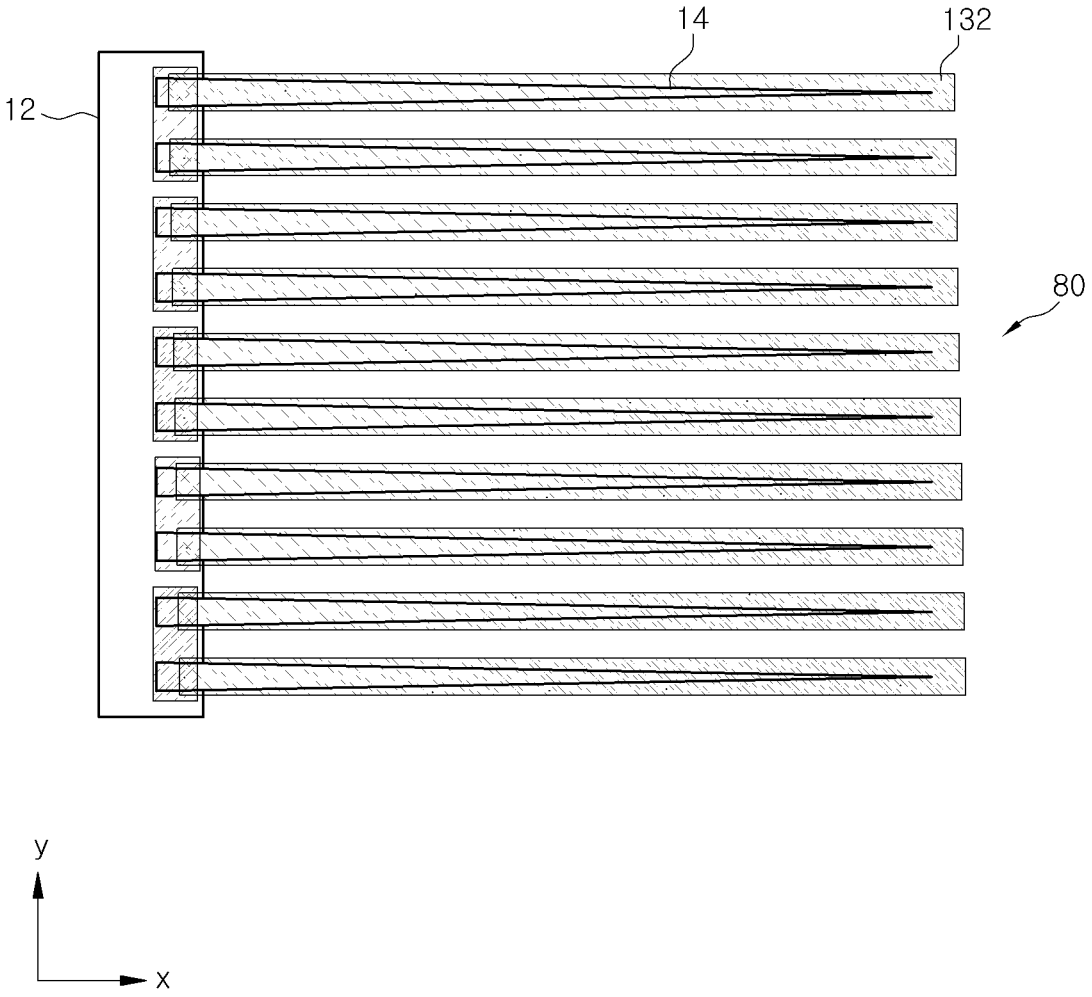

FIG. 4F shows another embodiment, in which a plurality of adhesive elements 132 having an angled-C shape are disposed on the artificial eyelash extension system 80. In one embodiment, each of the adhesive elements 132 may be configured as a single adhesive substrate. Otherwise, each of the adhesive elements 132 may be configured as separate adhesive substrates combined. Although FIG. 4F shows that the adhesive elements 132 are disposed to cover all of the eyelash filaments 14, the present embodiment is not limited thereto, and the number of the adhesive elements 132 may be determined to cover just some of the eyelash filaments 14.

Figure 4G:
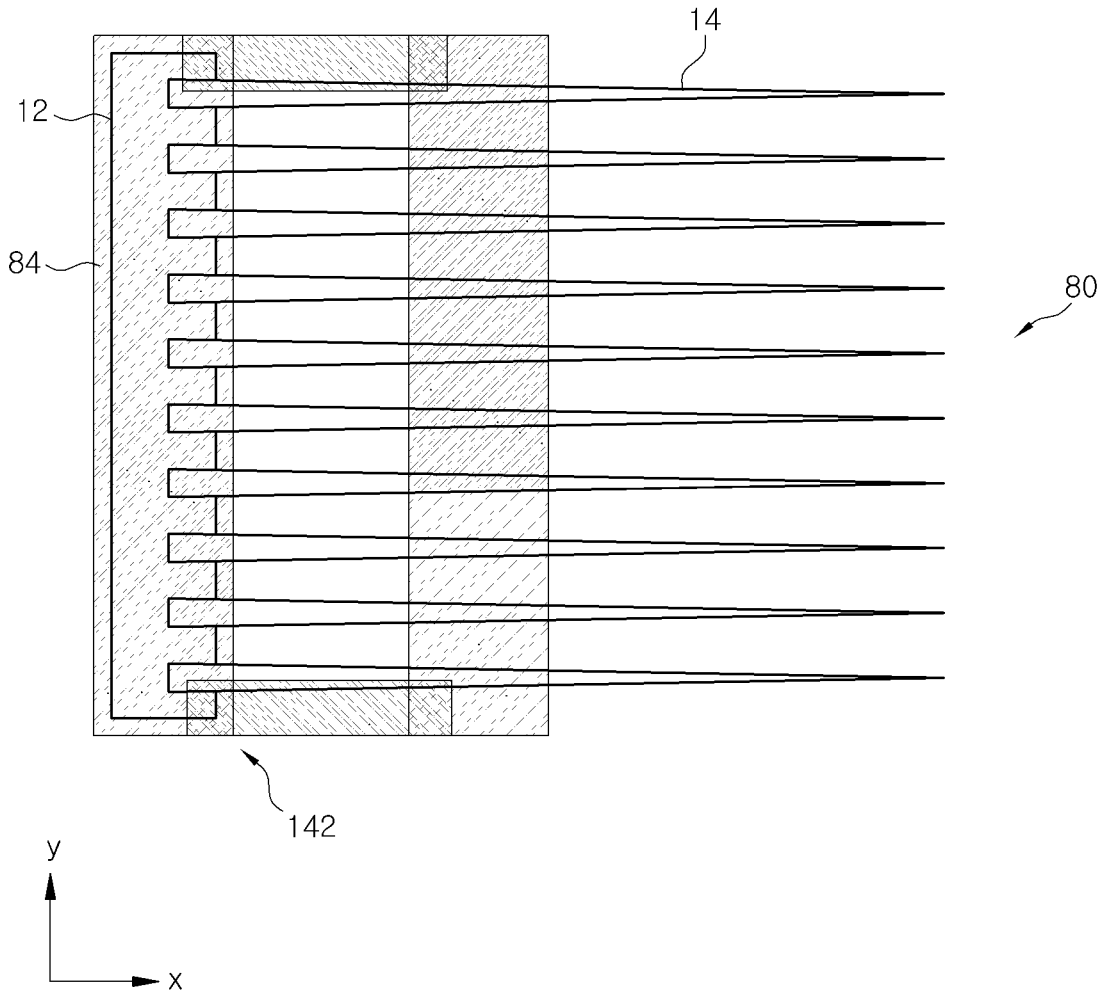

FIG. 4G shows an embodiment in which an adhesive element 142 having a rectangular shape is disposed on the artificial eyelash extension system 80. In one embodiment, the adhesive element 142 may be configured as a single adhesive substrate. Otherwise, the adhesive element 142 may be configured as separate adhesive substrates combined. Further, the x-axis dimension and y-axis dimension of each side of the adhesive element 142 are not limited to those illustrated in FIG. 4G, and they may be variously determined according to the particular style of an artificial eyelash extension system.

Figure 4H:
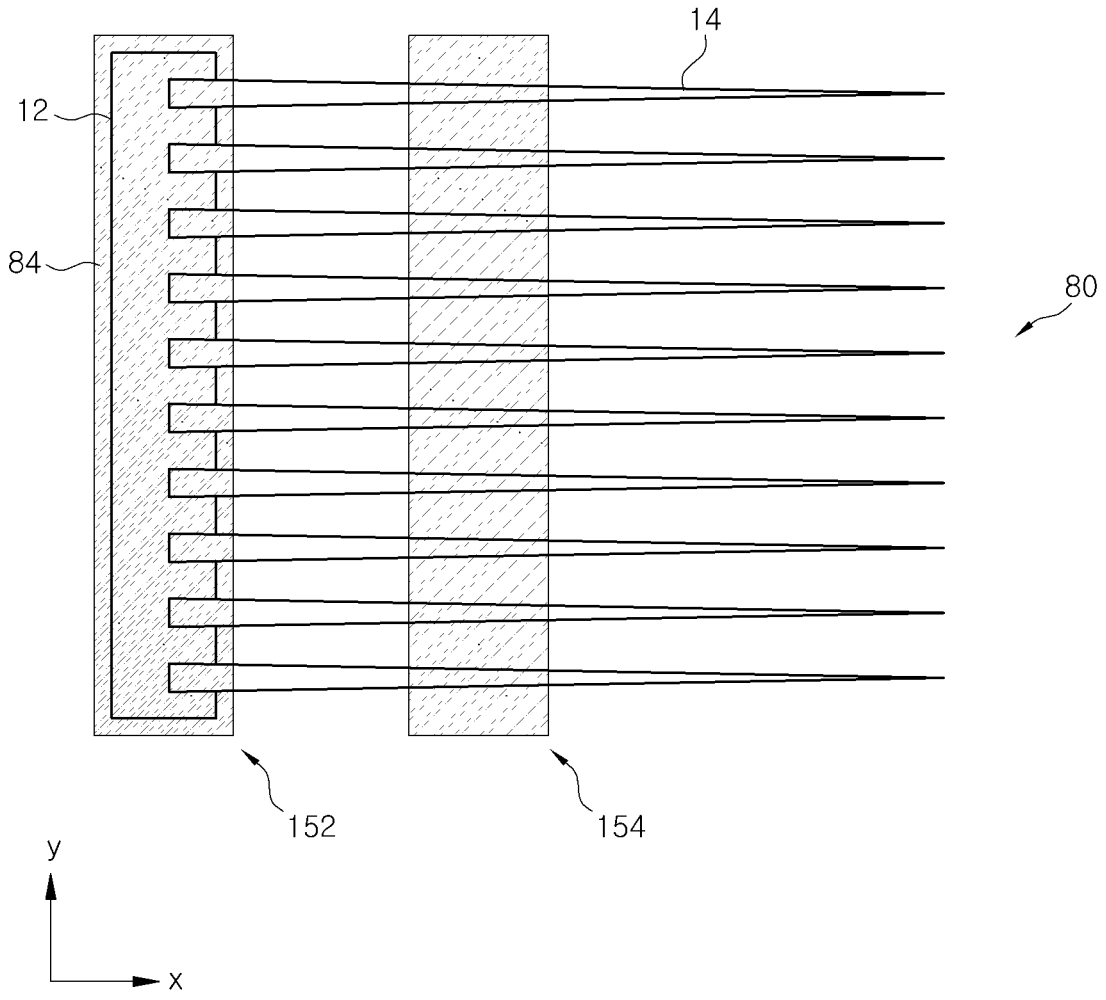

FIG. 4H shows an embodiment in which a first adhesive element 152 and a second adhesive element 154 are disposed on the artificial eyelash extension system 80. The first adhesive elements 152 is disposed on the artificial eyelash extension system 80 with a predetermined spacing from the second adhesive element 154. Otherwise, the first adhesive element 152 and second adhesive element 154 may be configured as a single adhesive substrate (as shown in FIG. 4J). Further, the x-axis dimensions and y-axis dimensions of the first and second adhesive elements 152, 154 are not limited to those illustrated in FIG. 4H, and they may be variously determined, respectively, according to the particular style of an artificial eyelash extension system.

Figure 4I:
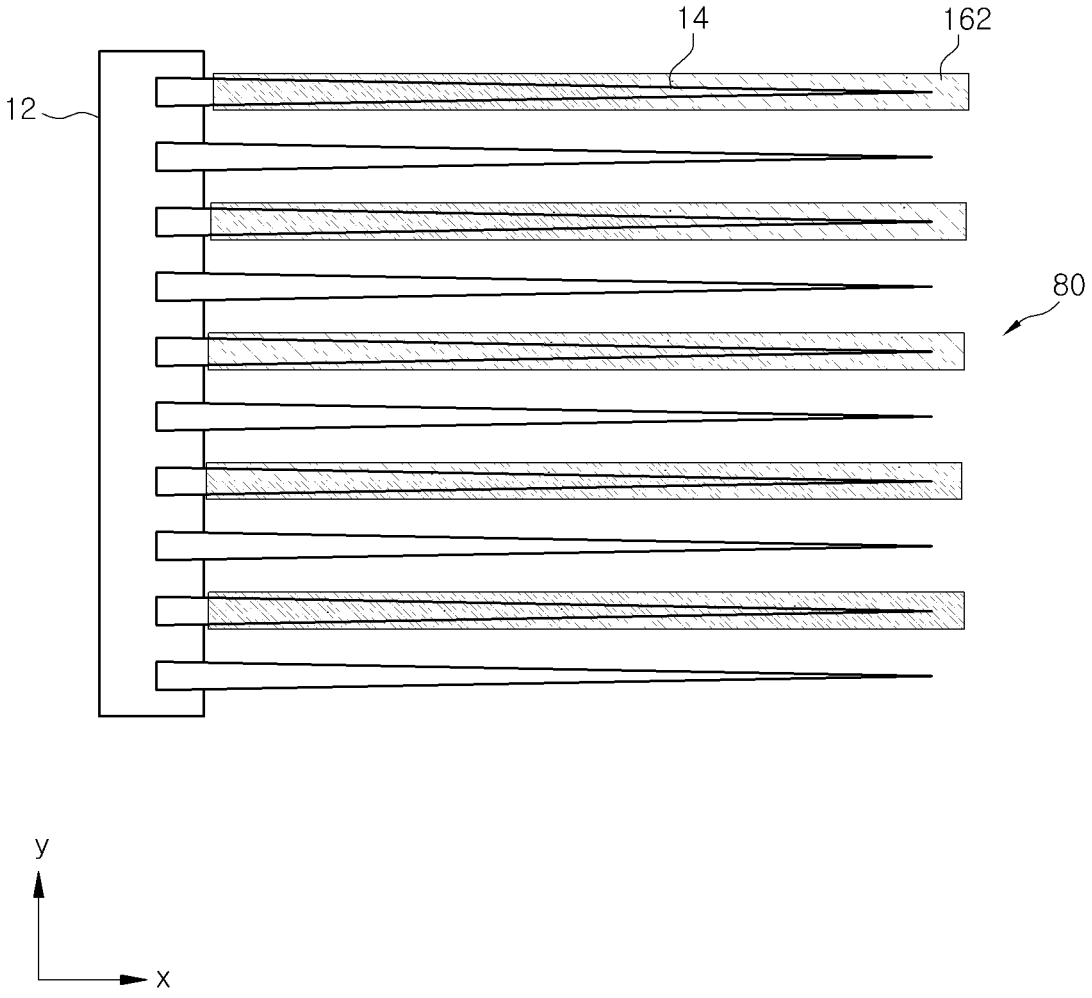
Figure 4J:
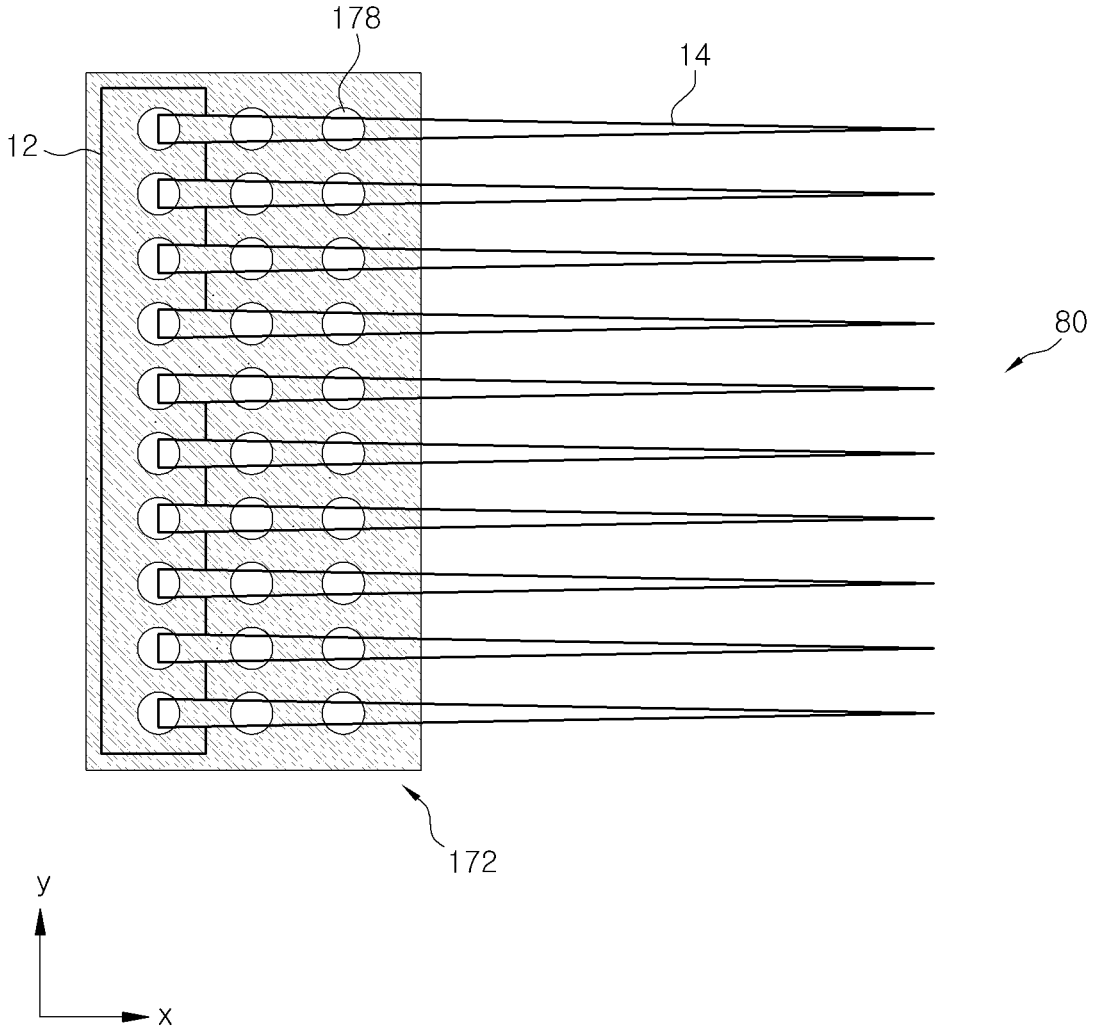

FIG. 4I shows an embodiment in which a plurality of adhesive elements 162 are comprised of just the spears disposed on some of the eyelash filaments 14 without a head 84 of FIG. 4A disposing on the support strip 12. Although FIG. 4I shows that the plurality of adhesive elements 162 are arranged to cover about half of the eyelash filaments 14, the present embodiment is not limited thereto, and the plurality of adhesive elements 162 may be arranged to cover more or less than half of the eyelash filaments 14.

FIG. 4J shows an embodiment in which a perforated adhesive element 172 having a plurality of holes 178 is disposed on the artificial eyelash extension system 80. The perforated adhesive element 172 is a single piece, but it can be made from multiple pieces of adhesive elements combined. The number of holes 178 is not limited to those illustrated in FIG. 4J, and the number of holes 178 may be variously determined according to the particular style of an artificial eyelash extension system. Further, although the shape of the hole 178 is illustrated as a circular shape in FIG. 4J, the present embodiment is not limited thereto, and the hole 178 may have various shapes, including oval, diamond, square, etc.

Figure 4K:
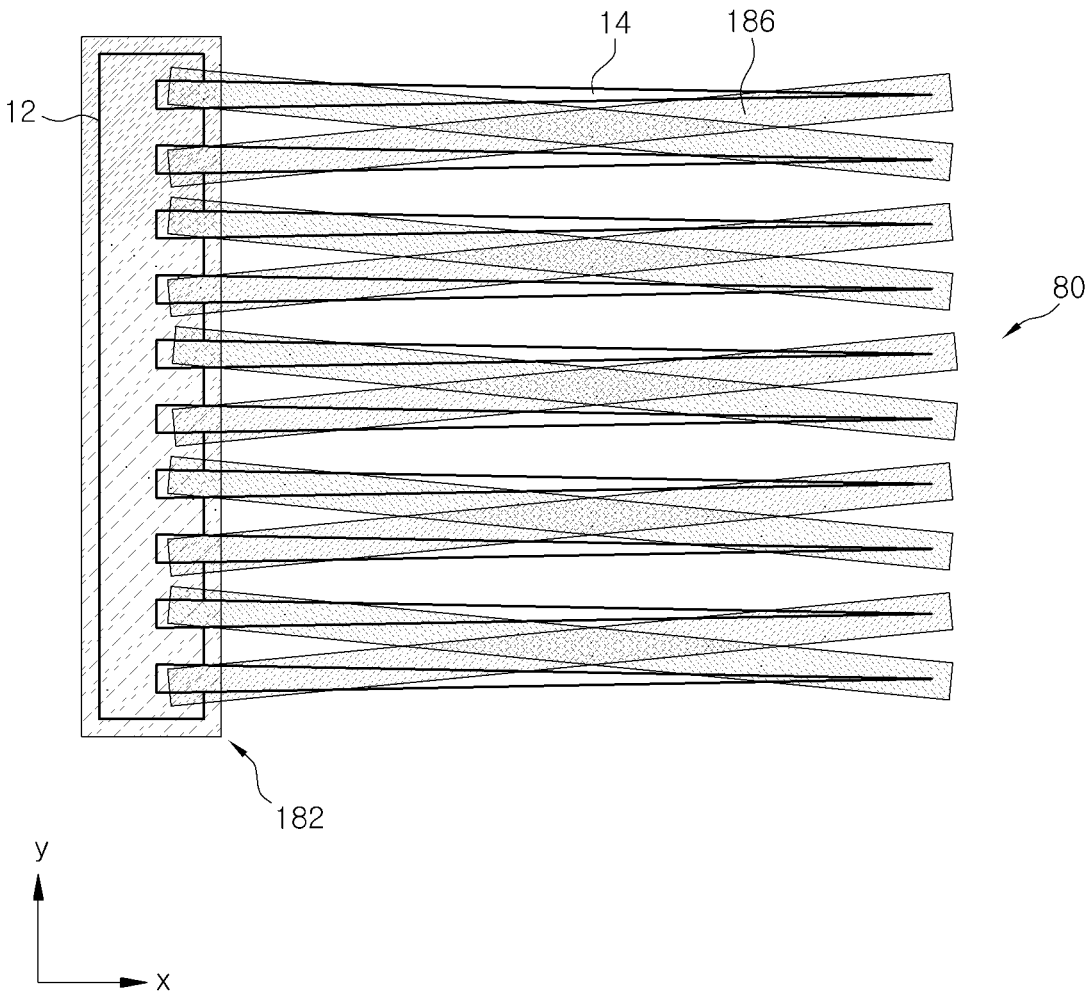

FIG. 4K shows an embodiment in which an adhesive element 182 is configured by arranging spears 186 to overlap and cross one another (e.g., forming an X-shape). The adhesive elements 182 may be configured as a single adhesive substrate. Otherwise, the adhesive element 182 may be configured as separate adhesive substrates combined.

Adhesive Element and Accompanying Layers for Packaging

Figure 5A:
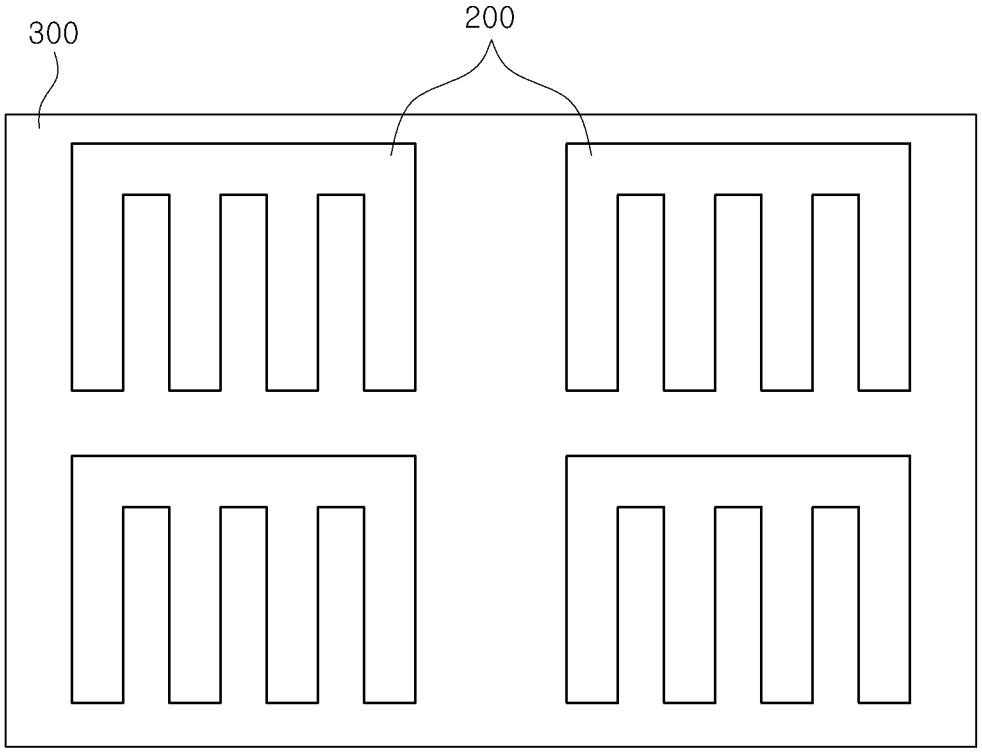
FIG. 5A depicts a plan view of an embodiment of an adhesive element stack in accordance with the features of the invention.
Figure 5B:
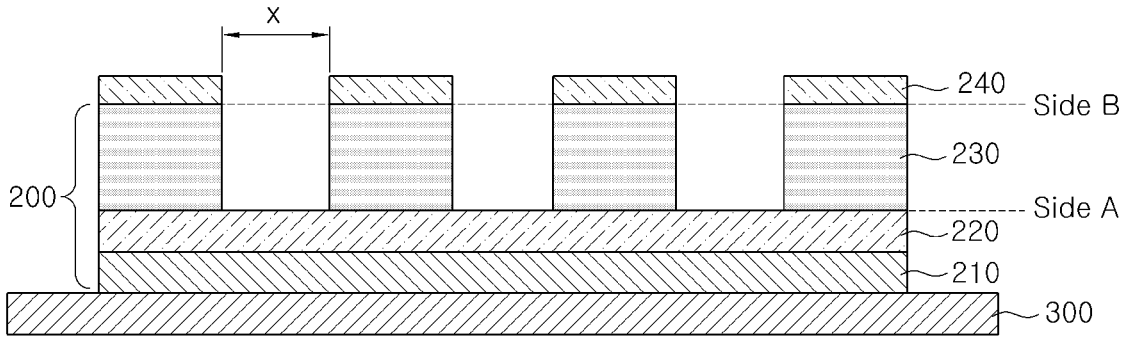
FIG. 5B depicts a cross-sectional view of the adhesive element stack of FIG. 5A.

The aforementioned adhesive elements of FIGS. 4A-4K may be manufactured, packaged, transported, and stored separately from the artificial eyelash extension system in order to facilitate these processes and reduce costs. FIG. 5A is a plan view of an adhesive element stack prepared prior to attaching to the artificial eyelash extension system, and FIG. 5B is a cross-sectional view of the adhesive element stack of FIG. 5A FIG. 5A shows that a plurality of adhesive element stack 200 is disposed on a substrate 300. The substrate 300 is the surface of a product tray on which artificial eyelash extension systems with adhesive element stack 200 are placed during packaging. The illustrated shape of the adhesive element stack 200 is simplified for convenience of drawing and description and is not limited to FIG. 5A, and the shape of the adhesive element stack 200 may vary according to the embodiments described above with reference to FIGS. 4A-4K.

FIG. 5B is a cross-sectional view of the adhesive element stack 200 of FIG. 5A. As shown in FIG. 5B, the adhesive element stack 200 may comprise multiple layers, including but not limited to a first double-sided tape 210, a protective film 220, and a second double-sided tape 230. The second double-sided tape 230 is the adhesive elements of FIGS. 4A-4K. As explained below, the protective film 220 is an optional layer. On Side B of the second double-sided tape 230 (or the adhesive element 230), an artificial eyelash extension system 240 is placed. The first double-sided tape 210 is placed on the substrate 300, which is the surface of a product display tray on which artificial eyelash extension systems with adhesive elements are placed during packaging. As explained below, Side A of the second double-sided tape 230 (or the adhesive element 230) is to be adhered to a user's natural eyelashes.

As shown in FIG. 5B, the first double-sided tape 210 is positioned above the substrate 300. The first double-sided tape 210 serves to secure the adhesive element stack 200 to the substrate 300 during the transportation and storage of the artificial eyelash extension systems 240 with the adhesive element stacks 200 of the present invention Optionally, the protective film 220 may be positioned above the first double-sided tape 210. The protective film 220 is attached to Side A of the second double-sided tape 230 (or the adhesive element 230) to be later removed by the user to expose Side A of the second double-sided tape 230 (or the adhesive element 230), which is to be adhered to the user's natural eyelashes. One purpose of the protective film 220 can be to minimize any foreign materials, such as dust, from adhering to Side A of the second double-sided tape 230 (or the adhesive element 230) prior to application to the user's natural eyelashes. Another purpose of the protective film 220 can be to prevent the first double-sided tape 210 and the second double-sided tape 230 (or the adhesive element 230) from being unintentionally separated by securely coupling the first double-sided tape 210 and the second double-sided tape 230 (or the adhesive element 230). Further, the protective film 220 can also serve to allow only the second double-sided tape 230 (or the adhesive element 230) to be easily detached from the protective film 220 but not the first double-sided tape 210 from the substrate 300. Although the protective film 220 and the first double-sided tape 210 are shown as separate components in FIG. 5B, they may be provided as one component. In one embodiment, the protective film 220 and the first double-sided tape 210 may be replaced with a protective film with adhesive property on one side only.

The second double-sided tape 230 (or the adhesive element 230) may be positioned above the protective film 220. In the manufacturing process, the second double-sided tape 230 (or the adhesive element 230) is attached to a support strip and/or eyelash filaments of an artificial eyelash extension system 240. Accordingly, the second double-sided tape 230 (or the adhesive element 230) serves to secure the artificial eyelash extension system on the user's natural eyelashes on Side A. The shape of the second double-sided tape 230 (or the adhesive element 230) is not limited to FIG. 5B, and it may be variously determined according to the embodiments described above with reference to FIGS. 4A-4K. In one embodiment, the second double-sided tape 230 (or the adhesive element 230) may be formed through laser processing of an adhesive substrate. Specifically, the second double-sided tape 230 (or the adhesive element 230) may be formed by removing the portion of the space x in the adhesive substrate with a laser.

Although exemplary implementations of the invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims.

It is to be understood that the above description is intended to be illustrative and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

What is claimed is:

1. An artificial eyelash extension system comprising:

a plurality of eyelash extensions, each of the plurality of eyelash extensions comprising:

a plurality of eyelash filaments, each of the plurality of eyelash filaments comprising a base and a tip; and a support surface configured to receive adhesive for applying the eyelash extension to a user's natural eyelashes or eyelid, wherein the support surface extends in a first direction across the bases of the plurality of eyelash filaments and includes a plurality of protrusions that extend in a second direction that is different from the first direction, and wherein the plurality of protrusions connect to the eyelash filaments.

2. The system of claim 1, wherein the support surface extends in the first direction a greater distance than its plurality of protrusions extend in the second direction.

3. The system of claim 2, wherein the distance the support surface extends in the first direction is at least twice the distance its plurality of protrusions extend in the second direction.

4. The system of claim 1, wherein the plurality of protrusions extend toward the tips of the eyelash filaments.

5. The system of claim 4, wherein the plurality of protrusions cross each other at a location between the bases and tips of the eyelash filaments to form a shape of a "X".

6. The system of claim 1, wherein adjacent ones of the plurality of protrusions are substantially parallel to each other in the second direction.

7. The system of claim 1, wherein adjacent ones of the plurality of protrusions form a shape of a "C" between where they extend in the second direction.

8. The system of claim 1, wherein the plurality of protrusions include at least a short spear and a long spear, and the long spear has a longer length in the second direction than the short spear, and wherein the short spear and the long spear extend alternatively in the second direction, and the short spear and the long spear are disposed on at least a portion of the plurality of eyelash filaments.

9. The system of claim 1, wherein the plurality of protrusions include at least a short spear and a long spear, and the long spear has a longer length in the second direction than the short spear, and wherein the long spears are disposed on opposite ends of the eyelash extension and the short spears are disposed between the long spears so that the support surface forms an arch shape.

10. The system of claim 6, wherein the plurality of protrusions include at least a first group of short spears and a second group of long spears, and each of the second group of long spears has a longer length in the second direction than each of the first group of short spears, and wherein the first group of short spears and the second group of long spears are alternatively disposed on at least four of the plurality of the eyelash filaments, such that there are at least two short spears on at least two eyelash filaments and at least two long spears on at least two other eyelash filaments.

11. The system of claim 1, wherein adhesive is applied to the support surface before the eyelash extension system is provided to the user.

12. The system of claim 11, wherein the adhesive is applied to the plurality of protrusions of the support surface and adapted to adhere to the user's natural eyelashes or eyelid.

13. The system of claim 11, wherein:

the adhesive has a first surface facing away from the support surface and a second surface facing toward the support surface, a strength of an adhesive property of the first surface is weaker than strength of an adhesive property of the second surface.

14. The system of claim 13, wherein a removable, protective film is disposed on the first surface.

15. The system of claim 11, wherein the adhesive includes a first adhesive element and a second adhesive element;

wherein the first adhesive element is disposed on the support surface and the second adhesive element is disposed across at least some of the plurality of eyelash filaments.

16. The system of claim 11, wherein the adhesive is applied to the support surface in a perforated shape having a plurality of holes.

17. A method for manufacturing an artificial eyelash extension system with adhesive already applied, the method comprising:

providing a plurality of eyelash extensions, each of the plurality of eyelash extensions comprising:

a plurality of eyelash filaments, each of the plurality of eyelash filaments comprising a base and a tip; and a support surface configured to receive adhesive for applying the eyelash extension to a user's natural eyelashes or eyelid, wherein the support surface extends in a first direction across the bases of the plurality of eyelash filaments and includes a plurality of protrusions that extend in a second direction that is substantially perpendicular to the first direction, wherein the plurality of protrusions connect to the eyelash filaments;

preparing an adhesive element package for each of the plurality of eyelash extensions, the adhesive element package including a tape, a protective film located on the tape, and an adhesive element located on the protective film, attaching each of the adhesive element packages on a substrate by attaching the tape to the substrate, attaching each of the plurality of eyelash extensions to a corresponding one of the adhesive element packages, and peeling the protective film from the tape so that the plurality of eyelash extensions, the adhesive elements, and the protective films are removed from the tape and the substrate.

18. The method of claim 17, wherein the adhesive element is formed through laser processing of an adhesive material.

19. The method of claim 17, wherein a shape of the adhesive element includes at least one of a fork shape, an arch shape, an X-shape, an angled-C shape, and a perforated shape.

20. The method of claim 17, wherein preparing the adhesive element package is performed separately from the remaining steps of manufacturing the artificial eyelash extension system.

21. An artificial eyelash extension system comprising:

a plurality of eyelash extensions, each of the plurality of eyelash extensions comprising:

a plurality of eyelash filaments, each of the plurality of eyelash filaments comprising a base and a tip; and an adhesive element that contacts the eyelash filaments for applying the eyelash extension to a user's natural eyelashes or eyelid, wherein the adhesive element includes a first portion extending in a first direction across the bases of the plurality of eyelash filaments and a plurality of protrusions that extend in a second direction that is different from the first direction, wherein the plurality of protrusions connect to the eyelash filaments, wherein the adhesive element is applied to contact the eyelash filaments before the eyelash extension system is provided to the user, and wherein the adhesive element is adapted to adhere to the user's natural eyelashes or eyelid.

22. The system of claim 21, wherein:

the adhesive element has a first surface facing away from the eyelash filaments and a second surface facing toward the eyelash filaments, a strength of an adhesive property of the first surface is weaker than strength of an adhesive property of the second surface.

23. The system of claim 21, wherein the adhesive element is applied in a perforated shape having a plurality of holes.

24. An artificial eyelash extension system comprising:

a plurality of eyelash extensions, each of the plurality of eyelash extensions comprising:

a plurality of eyelash filaments, each of the plurality of eyelash filaments comprising a base and a tip; and a support surface configured to receive adhesive for applying the eyelash extension to a user's natural eyelashes or eyelid, wherein the support surface extends in a first direction across the bases of the plurality of eyelash filaments and includes a plurality of protrusions that extend in a second direction that is different from the first direction, and wherein the support surface connects to the plurality of eyelash filaments at least at their bases;

wherein a portion of the plurality of protrusions connect to the eyelash filaments.

25. The system of claim 1, wherein each of the plurality of protrusions has a width greater than a width of each of the plurality of eyelash filaments.

26. The system of claim 1, wherein the second direction is substantially perpendicular to the first direction.

* * * * *